US009267776B2

(12) United States Patent
McClaughry et al.

(10) Patent No.: US 9,267,776 B2
(45) Date of Patent: Feb. 23, 2016

(54) PROTECTIVE PACKAGING FOR AMMUNITION

(71) Applicant: Tegrant Alloyd Brands, Inc., DeKalb, IL (US)

(72) Inventors: Thomas R. McClaughry, Chicago, IL (US); Virginia Cruz, DeKalb, IL (US); David John Sarver, Sycamore, IL (US)

(73) Assignee: Sonoco Development, Inc., Hartsville, SC (US)

( * ) Notice: Subject to any disclaimer, the term of this patent is extended or adjusted under 35 U.S.C. 154(b) by 545 days.

(21) Appl. No.: 13/676,561

(22) Filed: Nov. 14, 2012

(65) Prior Publication Data

US 2013/0118922 A1 May 16, 2013

Related U.S. Application Data

(60) Provisional application No. 61/559,439, filed on Nov. 14, 2011.

(51) Int. Cl.

| | |
|---|---|
| ***F42B 39/00*** | (2006.01) |
| ***F42B 39/26*** | (2006.01) |
| ***B65B 5/08*** | (2006.01) |

(52) U.S. Cl.
CPC .. *F42B 39/26* (2013.01); *B65B 5/08* (2013.01)

(58) Field of Classification Search
CPC ..... F42B 39/26
USPC ..... 206/3, 317, 372, 477, 480, 482, 560, 206/561, 564, 565, 587, 592, 593, 705; 220/4.22–4.24; 229/87.02
See application file for complete search history.

(56) References Cited

U.S. PATENT DOCUMENTS

| | | | | |
|---|---|---|---|---|
| 2,750,028 | A * | 6/1956 | Bode et al. | 206/3 |
| 3,589,511 | A * | 6/1971 | Britt | 206/564 |
| 3,835,994 | A * | 9/1974 | Davis et al. | 206/564 |
| 3,923,152 | A * | 12/1975 | Minneman | 206/3 |
| 4,840,276 | A * | 6/1989 | George | 206/564 |
| 5,360,109 | A * | 11/1994 | Janota | 206/564 |
| 5,474,179 | A * | 12/1995 | Iosif et al. | 206/521 |
| 5,842,567 | A * | 12/1998 | Rowe et al. | 206/471 |
| 6,216,885 | B1 * | 4/2001 | Guillaume | 206/564 |
| 7,556,152 | B2 * | 7/2009 | Lechelle | 206/564 |

* cited by examiner

*Primary Examiner* — Luan K Bui
(74) *Attorney, Agent, or Firm* — Dorsey & Whitney LLP

(57) ABSTRACT

A package for a plurality of ammunition units, each unit having an axially elongated casing with a base and a projectile joined to the casing opposite its base, is made from a thermoformed sheet, formed to have a plurality of elongated compartments for receiving an ammunition unit. Each compartment is recessed from a planar peripheral upper surface and has a cradling surface extending along an axis of an inserted ammunition unit for supporting its casing and first and second separation walls on opposed sides of the cradling surface. At least one of the first and second separation walls has an overhanging tab, resiliently deformable relative to the other opposed separation wall to receive and grasp the casing upon insertion or to allow removal of the casing.

12 Claims, 22 Drawing Sheets

PROTECTIVE PACKAGING FOR AMMUNITION

TECHNICAL FIELD

The present disclosure relates to the field of thermoformed packaging materials. More particularly, the present disclosure relates to thermoformed protective packing for ammunition.

BACKGROUND

Various forms of ammunition are known in the art. Generally speaking, ammunition includes any device capable of propelling at least one projectile toward a target (with or without directional guidance) upon the ignition of a propellant. Specific examples of ammunition include, but are not limited to, cartridge systems, high explosive projectiles, warheads, shaped charges, carrier projectiles, mortar ammunition, small arms ammunition, grenades, mines, pyrotechnics, improved conventional munitions, and terminally guided munitions.

One common example of an ammunition unit is a bullet/cartridge system. Such ammunition, which is typically referred to as a cartridge, is used in connection with various types of small arm weapons, including hand guns, pistols, rifles, machine guns, and the like. FIG. 9 depicts the components of an example cartridge 10. A bullet or projectile 1, which is typically made of copper, brass, lead or other metal, is inserted at its base end within the open end of a casing 2. The casing 2, which is typically made of brass, steel, copper, aluminum, or other metal, contains a propellant 3, which may be gunpowder, cordite, or the like. The base end of the casing 2 includes a rim 4, which is used to load and position the cartridge into and in a weapon for which the cartridge is designed and dimensioned. The base end of the casing 2 also includes a primer 5, which serves to ignite the propellant in cooperation with the firing pin of the weapon.

As is well known in the art, certain areas or components of ammunition are particularly susceptible to damage when mishandled. Such damage may occur, for example, during manufacture, shipping, transportation, or loading of the ammunition. These areas or components of the ammunition, which will be referred to herein collectively as "key areas," should be treated with care during times when ammunition is susceptible to damage. These key areas include, but are not limited to: the area of contact between the casing and the projectile (referring to FIG. 9, the area where the base of the bullet 1 is inserted within the casing 2)—if this area is damaged, the projectile may misfire upon leaving the casing; the means for loading and securing the ammunition into the respective weapon (referring to FIG. 9, the rim 4, which is the part of the casing that assists in loading and aligning the cartridge for firing)—if this area is damaged, the ammunition may jam or otherwise improperly load into the weapon; the projectile (referring to FIG. 9, the bullet 1), which will have less accurate flight if its designed shape is impaired; and the ignition means for the ammunition (referring to FIG. 9, the area including and surrounding the primer 5)—if this area is damaged, the ammunition may not fire when the firing means of the weapon (e.g., the firing pin of a gun or rifle) is brought in operative connection therewith.

As mentioned above, shipping and transportation are two particular times when ammunition is susceptible to damage. This is because shipping and transportation generally includes the movement, loading, stacking, handling, jostling, and other forms of physical manipulation of the packaging within which the ammunition is held. During such times, depending on the cartridges, their packaging and the forces developed in the physical manipulation, cartridges can contact one another, contact the packaging, or otherwise be subject to physical forces from the outside that may cause damage. This is particularly true of the aforementioned key areas, which, by their very nature, may be more susceptible to damage than other areas of the ammunition.

Some known forms of ammunition packaging provide little protection for the ammunition, including its key areas, during shipping and transportation. For example, it is common to simply package a plurality of cartridges loose within a cardboard or paperboard box. In this type of packaging, the cartridges are free to move about and contact one another, which could potentially lead to damage. Other known forms of ammunition packing, which do provide a measure of protection to the ammunition, are bulky, expensive, and/or wasteful from an environmental perspective. For example, it is common to ship cartridges (as in FIG. 9), in what is may be referred to as a "test tube rack" form of packaging. The cartridges are inserted upright into aligned openings in the rack, which may be able to accommodate eight or more cartridges at a time. The racks are typically injection molded from plastic. While these racks do afford a measure of protection against damage, they require a considerable amount of plastic to manufacture, they are heavy and bulky, and they require expensive dies and complicated machinery to manufacture.

Thus, what is needed in the art is an improved form of ammunition packaging that affords protection to the ammunition during shipping and transportation. What is further needed is a form of packaging that is light weight, compact, easy to manufacture, and environmentally friendly (e.g., uses as little material as possible and/or is readily recyclable or biodegradable).

SUMMARY

In one embodiment, disclosed herein is a package for holding a plurality of ammunition units, each unit having an axially elongated casing with a base and a projectile joined to the casing opposite its base, comprising: a thermoformed sheet, formed to have a plurality of elongated compartments for receiving an ammunition unit, each compartment recessed from a planar peripheral upper surface and comprising: a cradling surface extending along an axis of an inserted ammunition unit for supporting its casing; and first and second separation walls on opposed sides of the cradling surface, at least one of the first and second separation walls comprising an overhanging tab, resiliently deformable relative to the other opposed separation wall to receive and grasp the casing upon insertion or to allow removal of the casing.

In another embodiment, disclosed herein is a method of packaging ammunition, comprising, inserting an ammunition unit into a thermoformed tray, wherein the thermoformed tray comprises a plurality of individual compartments, each such compartment being configured for receiving a unit of ammunition between a pair of opposed separating walls and being formed at molded bend in the thermoformed sheet during insertion, and deflecting a portion of at least one of the separation walls, which then applies a resilient force urging inserted ammunition unit against a cradling surface of the compartment.

In yet another embodiment, disclosed herein is a package for holding a plurality of ammunition units, each having a casing with a base and a projectile joined to the casing opposite its base, comprising: a thermoformed sheet, formed to have a plurality of compartments for receiving an ammunition unit, each compartment recessed from a peripheral surface and comprising: a supporting surface extending along an inserted ammunition unit for supporting its casing; first and second separation walls on opposed sides of the supporting surface, wherein the separation walls are formed by a molded bend in the thermoform sheet; and at least one protection portion for protecting a key area of the ammunition from impact.

While multiple embodiments are disclosed, including variations thereof, still other embodiments of the present disclosure will become apparent to those skilled in the art from the following detailed description, which shows and describes illustrative embodiments of the disclosure. As will be realized, the disclosure is capable of modifications in various aspects, all without departing from the spirit and scope of the present disclosure. Accordingly, the drawings and detailed description are to be regarded as illustrative in nature and not restrictive.

DESCRIPTION OF THE FIGURES

While the specification concludes with claims particularly pointing out and distinctly claiming the subject matter that is regarded as forming the present disclosure, it is believed that the disclosure will be better understood from the following description taken in conjunction with the accompanying Figures, in which:

DETAILED DESCRIPTION

Figure 1:
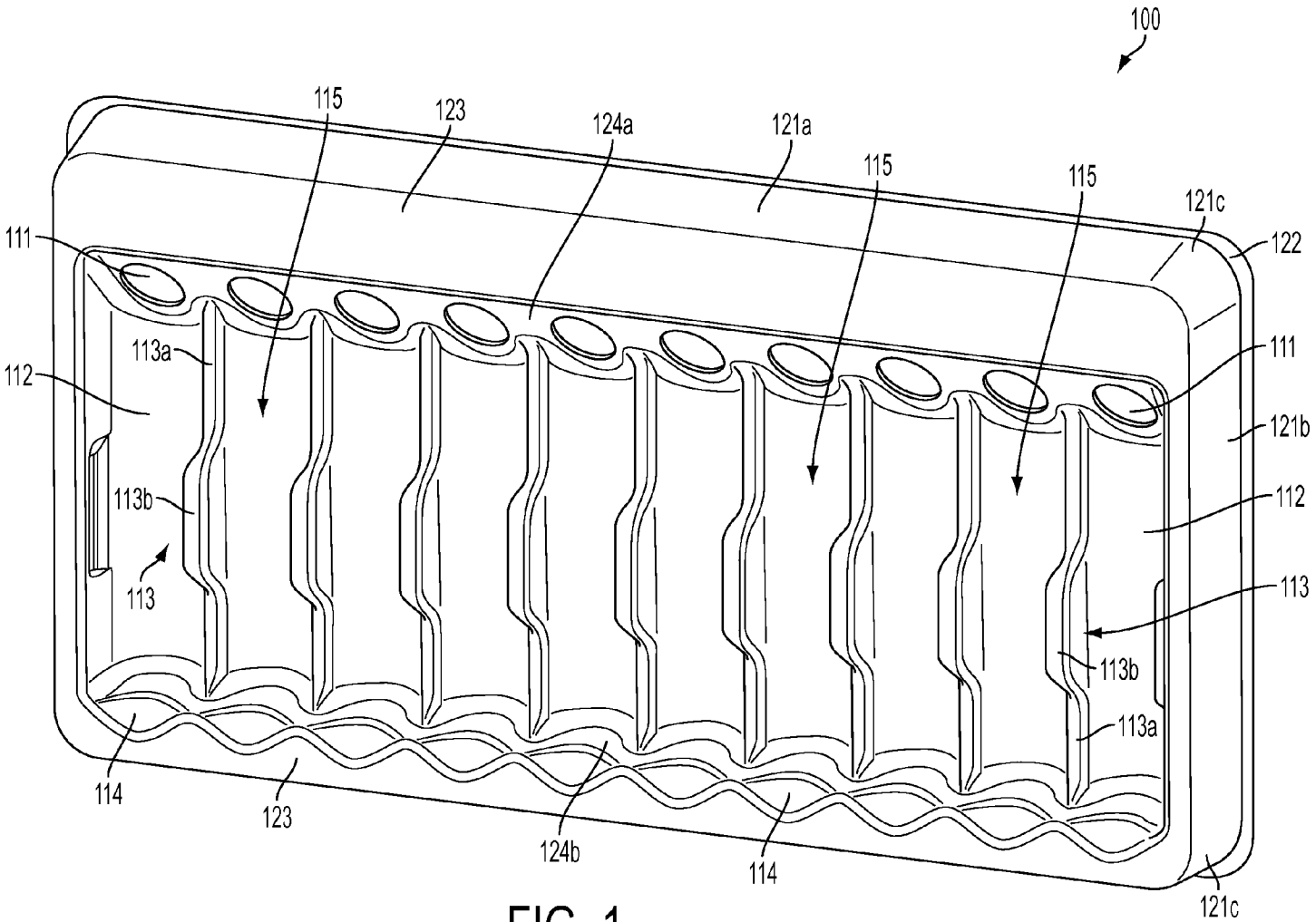
FIG. 1 is a top perspective view of one embodiment of ammunition packaging in accordance with the present disclosure.

Background.

The present disclosure describes various embodiments of thermoformed protective packing for ammunition. Thermoforming, as used herein, generally refers to a manufacturing process where a plastic sheet is heated to a pliable forming temperature, formed to a specific shape in a mold, and additionally die cut and/or trimmed to create a usable product. The plastic sheet, or "film", when referring to thinner gauges and certain material types, is heated in an oven to a high-enough temperature that it can be pulled or pressed into or onto a mold and cooled to a finished shape. Thermoforming is suitable for use in high-volume applications, where production machines are utilized to heat and form the plastic sheet and trim the formed parts from the sheet in a continuous, high-speed process. This can produce many thousands of finished parts per hour depending on the machine and mold size and the size of the parts being formed.

In one embodiment, a high-volume, continuous thermoforming process of thin-gauge products may include a plastic sheet being fed from a roll or from an extruder into a set of indexing chains that incorporate pins, or spikes, or similar means that pierce the sheet and transport it through an oven for heating to forming temperature. The heated sheet then indexes into a form station where a mating mold and pressure-box close on the sheet, with vacuum then applied to remove trapped air and to pull the material into or onto the mold to form the plastic to the detailed shape of the mold. For packages where higher dimensional accuracy is desired, the vacuum molding can be enhanced by applying pressurized air or other gas to the side opposite the side where vacuum is applied, to urge the sheet into greater conformity with mold details. After a short forming cycle, a burst of reverse air pressure is actuated from the vacuum side of the mold as the form tooling opens, commonly referred to as air-eject, to break the vacuum and drive the formed parts off of, or out of, the mold. A stripper plate may also be utilized on the mold as it opens for ejection of more detailed parts or those with negative-draft, undercut areas. The sheet containing the formed parts then indexes into a trim station, where a die cuts the parts from the remaining sheet web, or indexes into a separate trim press where the formed parts are trimmed. The additional steps of trimming and any aperture cutting may be done at the same or at separate stations. The sheet web remaining after the formed parts are trimmed is typically wound onto a take-up reel or fed into an inline granulator for recycling.

As such, thermoforming is a process that uses minimal amounts of material, for example, thin film plastics as described above, and is more environmentally friendly than many injection forming processes. It is also environmentally friendly in that it can use recycled materials, and can be configured to recycle excess or scrap material that results from the thermoforming process itself. Further, thermoforming is a fast, efficient, and highly repeatable process, capable of producing many components in a short amount of time, thus reducing manufacturing costs where a high volume of product is required. However, it may require significant design skill to produce a package configuration that meets all the physical requirements and is also efficiently manufacturable by this process.

First Embodiment

Figure 3:
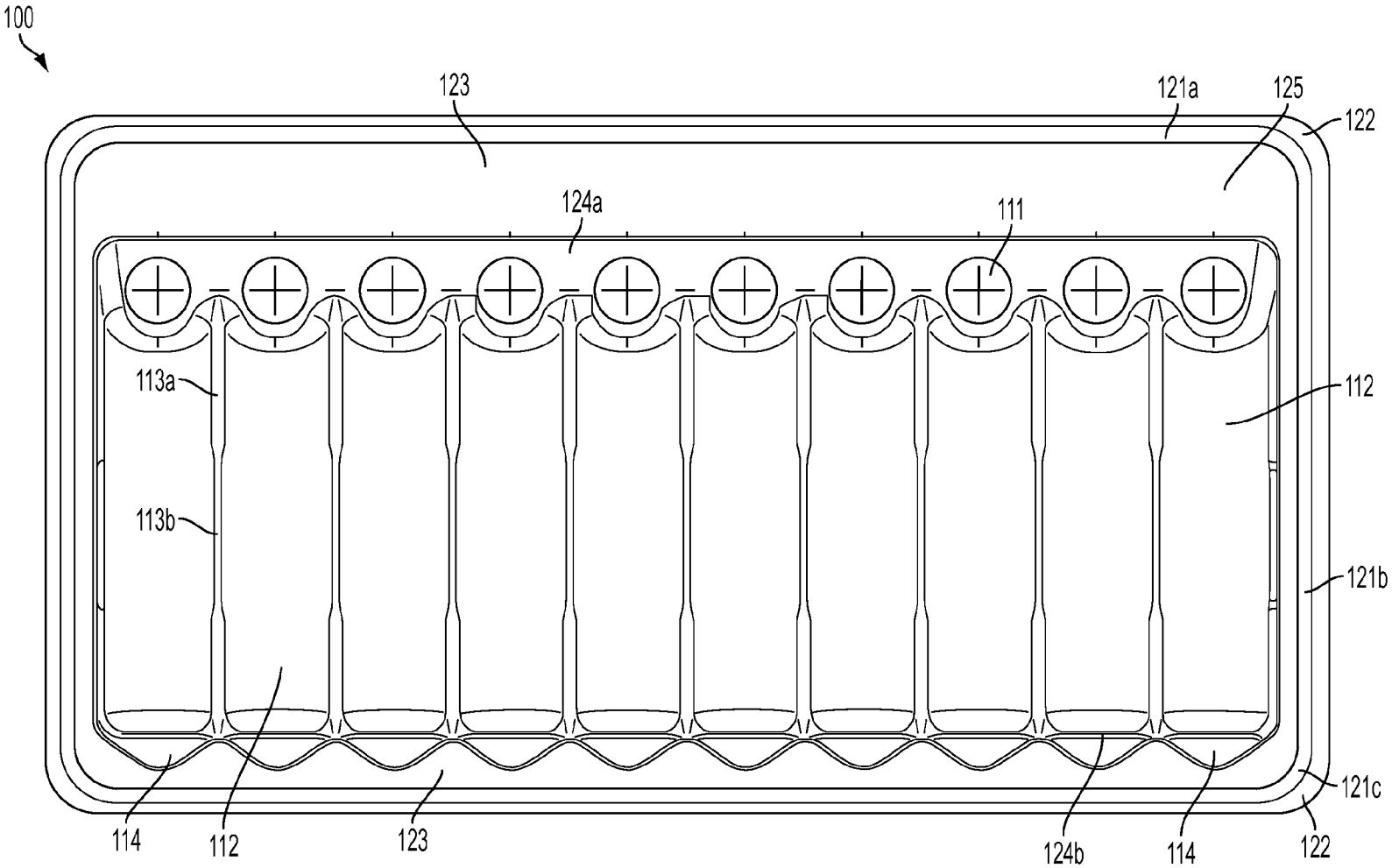
FIG. 3 is a bottom plan view of the ammunition packaging embodiment of FIG. 1.
Figure 4:
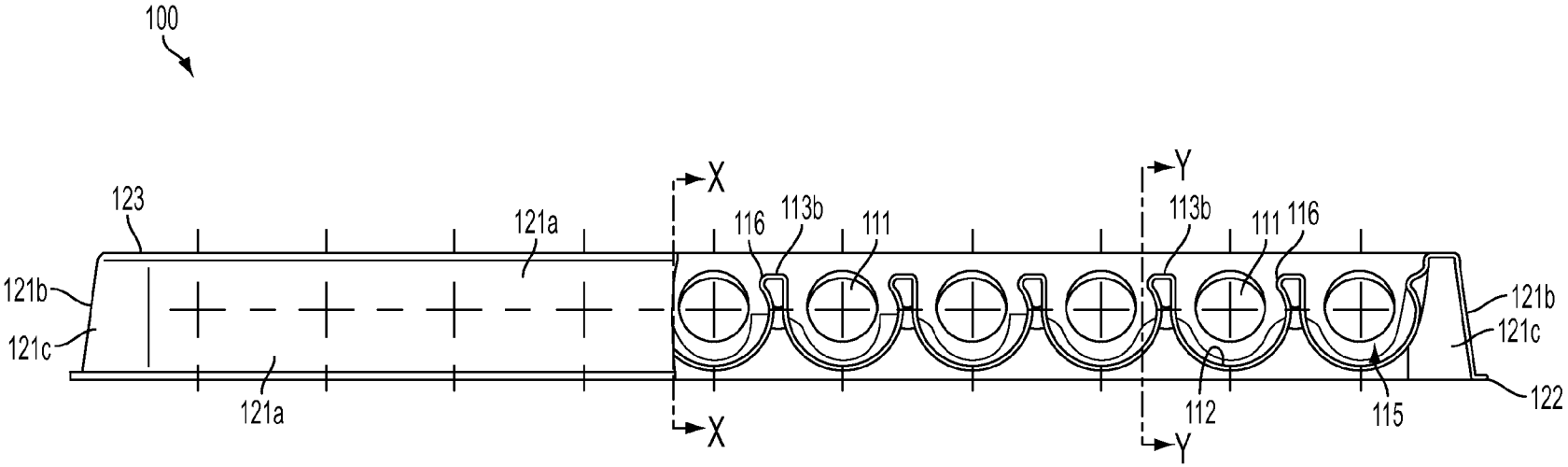
FIG. 4 is front side and partial sectional view of the ammunition packaging embodiment of FIG. 1, wherein the sectional view to the right of line X-X is taken along line 4-4 of FIG. 2.
Figure 5:
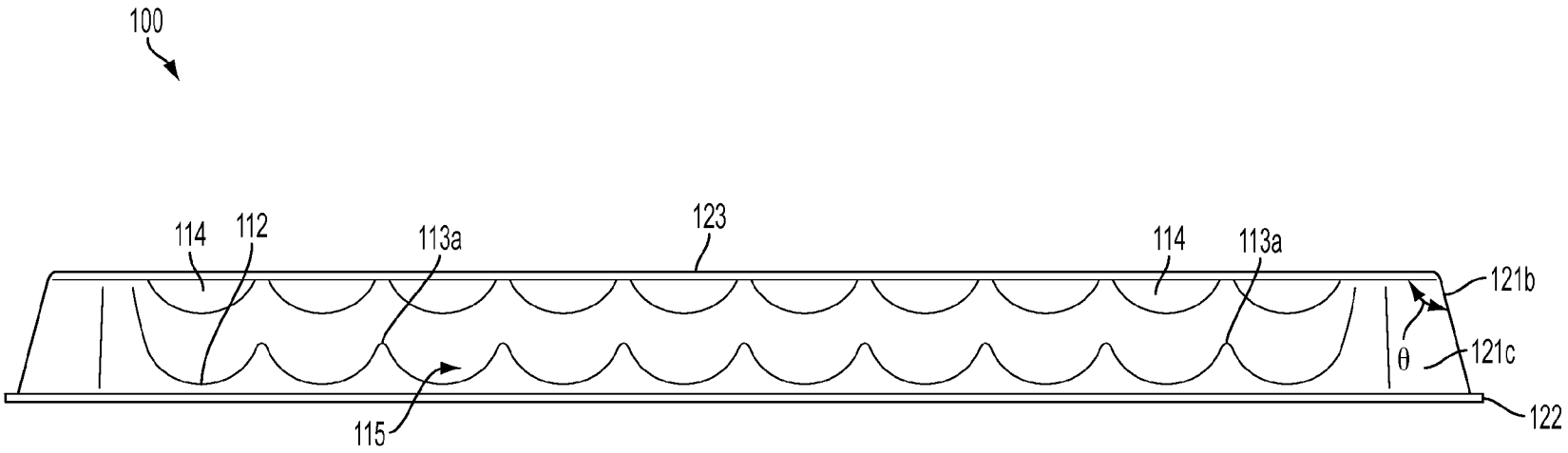
FIG. 5 is a back side sectional view of the ammunition packaging embodiment of FIG. 1, wherein the sectional view is taken along the line 5-5 of FIG. 2.
Figure 6:
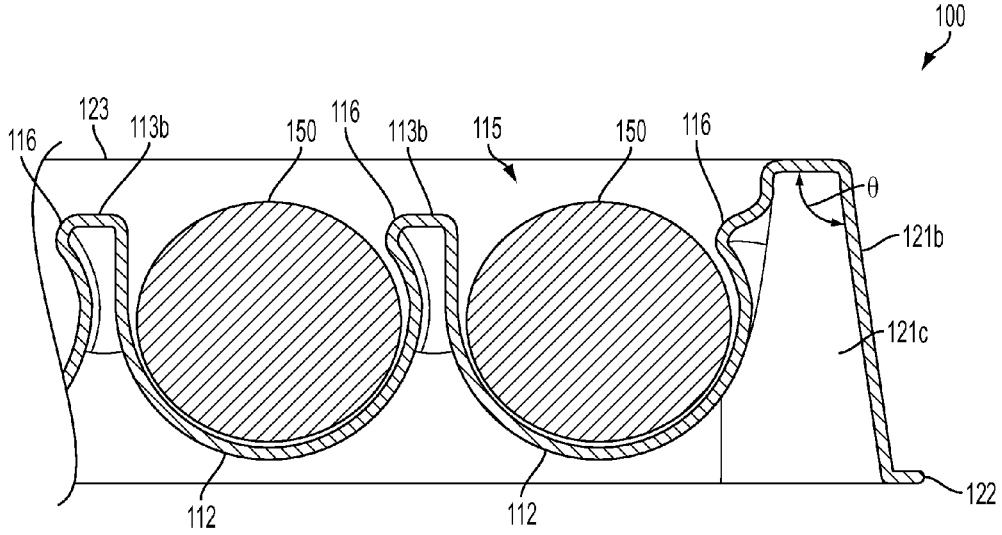
FIG. 6 is an enlarged detail view of FIG. 4, taken to the right of line X-X thereof, augmented with a depiction of ammunition placed within the packaging.
Figure 7:
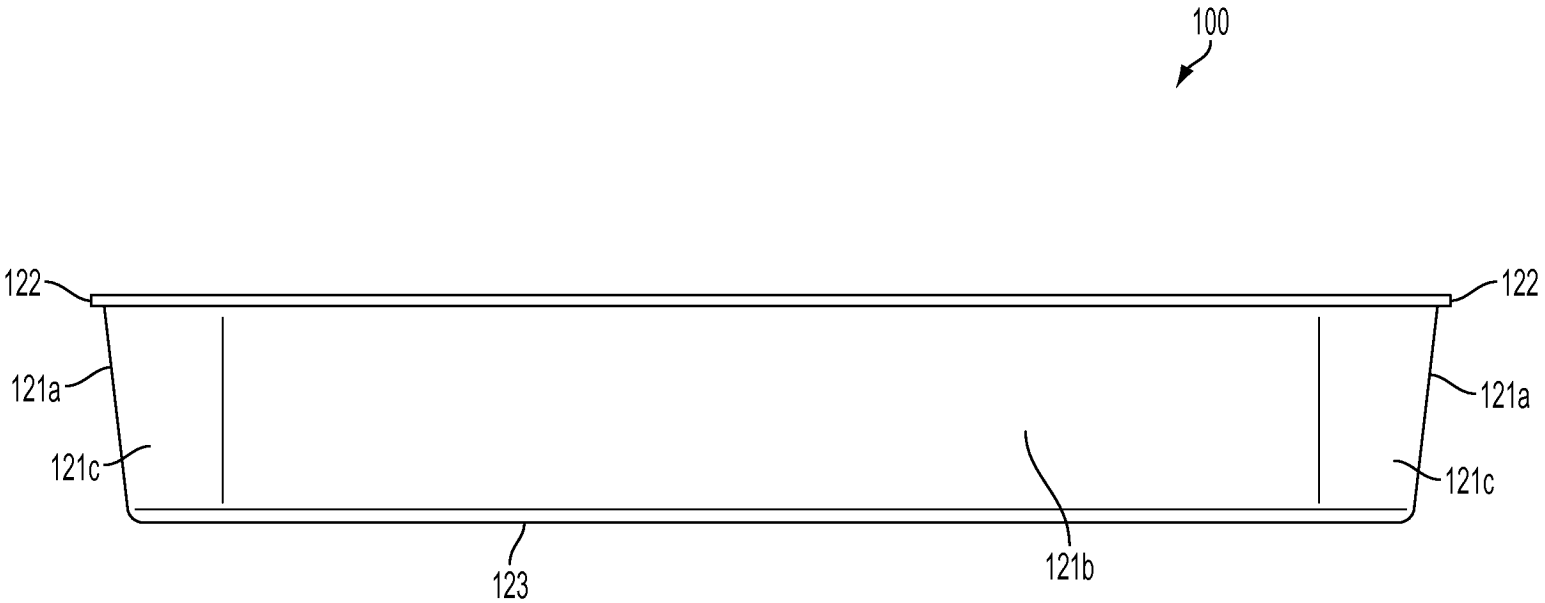
FIG. 7 is a side view of the ammunition packaging embodiment of FIG. 1, inverted as compared to FIGS. 4-6.

With reference now to particular embodiments of the invention, disclosed in FIGS. 1-7 is a thermoformed protective packaging tray 100 for use in packaging ammunition, in particular, ammunition units comprising elongated cartridges. The tray may be generally rectangular in shape, having a length, width, and height. As seen best in the top views (FIGS. 1 and 2), the packaging tray 100 may include a substantially planar upper peripheral surface 123 that extends about peripheral portions of the top face of the packaging tray 100. At the outer perimeter of the upper peripheral surface 123 four walls may be connected. The two length-wise side walls 121*a* may be connected to the two width-wise end walls 121*b* at rounded corners 121*c* (four rounded corners 121*c* appear in the rectangular embodiment shown). Referring now also to FIGS. 5 and 6, the wall pairs 121*a*, 121*b* are connected to the upper peripheral surface 123 at an angle θ that is slightly greater than perpendicular, for example, generally between about 95 degrees and 120 degrees. This off-perpendicular connection between the upper peripheral surface 123 and the walls 121*a*, 121*b* allows for closer nesting of multiple empty trays on top of one another, as will be discussed in greater detail below with regard to FIG. 8. A peripheral flange 122 (narrow, as shown, but wider in other embodiments) will typically remain connected to the walls 121*a*, 121*b* at the lower edges thereof, opposite the connection with the upper peripheral surface 123 (i.e., the lower rim of the package) as an artifact of the thermoforming process or as a matter of design. (Such flange 122 may be used to add wall strength or to provide support for a blister or other enclosure to be provided with the tray, and sealed thereto, to complete the packaging). In some embodiments, however, one or more of walls 121*a* and 121*b* need not be included on the tray 100.

Figure 9:
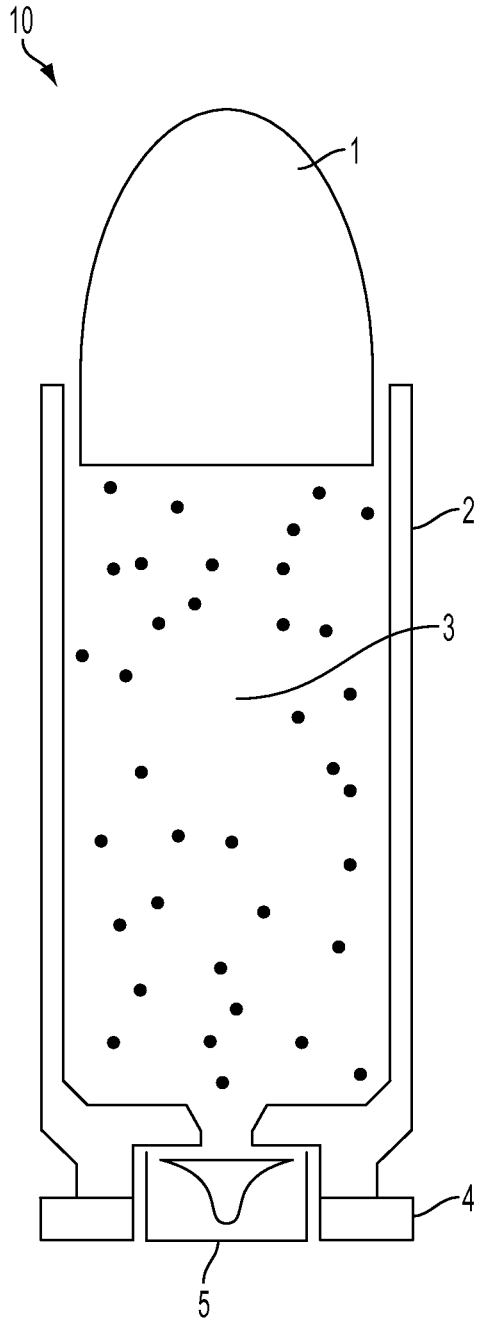
FIG. 9 is an example cross-sectional view of a unit of ammunition as may be packaged within embodiments of the present disclosure.

While a rectangular-shaped tray is shown in the embodiment of FIGS. 1-7, it should be appreciated that the tray is not limited to rectangular forms, or to rectangular forms with dimensions substantially as shown. Rather, other shapes are presently contemplated, including square, circular, oval, ovoid, triangular, polygonal, and others. Further, a wide range of tray thicknesses (height of the walls 121*a*, 121*b*) is contemplated. In choosing a particular shape and size, it is contemplated that the type and number of cartridges sought to be packaged will determine the dimensions employed. In the example depicted in the Figures, the length of the tray 100 is determined by the number of cartridges sought to be packaged and such cartridges' width or diameter (as a multiple thereof), the width of the tray is determined by the length of the cartridge, and the height of the tray is determined by the width or diameter of the ammunition. In particular, the ammunition units contemplated in connection with the Figures are elongated cartridges as shown in FIG. 9, such as rifle cartridges.

Referring to FIGS. 3 and 4, recessed downwardly from the plane of the upper peripheral surface 123, and situated inwardly therefrom, are provided a plurality of ammunition storage compartments 115. As shown in the Figures, ten ammunition storage compartments 115 are provided in this example embodiment, enabling ten cartridges to be stored in the packaging tray 100. Each ammunition storage compartment 115 is elongated, extending between the generally opposed pair of walls 121*a* and defined on the bottom side thereof by an ammunition supporting or cradling surface 112, on lateral sides thereof by ammunition separating walls 113, on the front side thereof by a front interior wall 124*a*, and on the rear side thereof by a rear interior wall 124*b*. The elongated configuration is useful for ammunition such as cartridges, which have a generally elongated shape. However, compartments may be shaped so as to accommodate whatever ammunition type is being packaged.

With particular attention to ammunition cradling surfaces 112, such surfaces may be provided in a shape to substantially match a portion of the shape of the ammunition sought to be packaged. In the example embodiment shown in the Figures, where, as previously mentioned, the desired ammunition is cartridges, the ammunition cradling surfaces 112 are curved to substantially match the curvature of the casing 2. In this manner, the casing is supported in place through direct contact, on its bottom side (i.e., the ammunition is "cradled"), with a curved cradling surface 112. Each compartment 115 is provided with such a surface 112. In particular, the detail view of FIG. 6 shows cartridges 150 being supported in place, axially along the lower portions of their respective casing circumferences, by supporting or cradling surfaces 112. Other cradling surface 112 shapes may be required where the ammunition is of different shape, e.g., flat, angled, irregular, etc. The cradling surface may be continuous as shown or have interruptions or apertures (not shown).

With particular attention to ammunition separating walls 113, such walls may be provided to ensure separation between each ammunition unit so that the ammunition unit does not come in contact with the adjacent unit during shipping and transportation. As shown, the thickness of separating walls 113 is relatively small, for example, less than about 25% of the width of the compartments 115. This allows the ammunition to be "dense-packed" within the tray (thus reducing the needed size of the tray and the needed amount of material), while still maintaining adequate separation between the ammunition. The walls 113 in the figures are arranged parallel to one another and are generally straight, in order to accommodate cartridges which are generally continuous and straight along their casing length. However, non-parallel or non-straight walls 113 may be provided where the shape of the enclosed ammunition so dictates. Separating walls 113 can be formed as molded bends in the thermoform sheet, resulting in a cavity, negative space or relief therebeneath as shown in FIG. 3. Alternatively, the package may be formed from two separately-formed thermoformed components. One may be a base thermoformed component, with the overall structure but without certain detail features, which are made in a second, thermoformed insert component that may be fitted into or onto a portion of the base thermoformed component. For example, separating walls 113 may be formed as a separate transverse strip, and by inserting this additional strip into the base thermoformed component after it has been thermoformed. The strip is configured for a friction fit into or onto the base thermoformed component, such that its features are added at specific locations in the base thermoformed component.

In some embodiments, the separating walls 113 may include two or more portions. A first portion 113*a*, which may be referred to as a separating portion, and a second portion 113*b*, which may be referred to as a securing portion, are shown in the Figures. Whereas portion 113*a* generally serves to separate adjacent ammunition units from one another, as described above, securing portion 113*b* not only serves a separation purpose, but also a securing purpose with respect to the ammunition. As best seen in FIG. 1, FIG. 4 (to the right of line X-X) and FIG. 6, securing portion 113*b* has a greater height than separating portion 113*a*. Further, securing portion 113*b* includes an extending portion 116 configured as an overhanging tab that extends somewhat over the compartment 115, and is contoured to match the contour of the cartridge casing (see FIG. 6), thus resulting in an area of contact therebetween. Alternatively, the overhanging tab may be contoured to provide only a tangent line of contact. This extending portion 116 includes an undercut geometry that protrudes over the top of the lateral tangent point of the cartridge on one side thereof. On the other side of compartment 115, opposite the extending portion 116 on the securing portion 113*b* is a generally vertical wall, which serves to hold the cartridge in place with reference to the extending portion 116. In embodiments where the separating walls 113 are formed by a molded bend in the thermoform sheet, the overhanging tab of the extending portion 116 is formed by broadening the cavity under the bend, relative to the amount of separation between the ascending and descending portions of the sheet leading to the bend.

Thus, between the supporting or cradling surface 112 and the securing portion 113*b*, approximately 50% (in one embodiment greater than 50%) of the circumference of the cartridge casing may be supported in close contact with the surfaces of at least a portion of the length of compartment 115 (see FIG. 6). (In contrast, the separating portion 113*a* does not extend as high as the securing portion 113*b*, typically to a height that is less than half the diameter or width of the ammunition, as is shown best in FIG. 5. In effect, securing portion 113*b* may be viewed as a securing tab, extending upward from the separating portion 113*a* of a wall 113.). As such, the secured cartridge will not be free to move easily in any direction normal to its longitudinal axis when positioned within the compartment 115. In order to more easily insert or remove the ammunition, the extending portion 116 may be resiliently deformable. Such resilient deformation may be a result of thermoforming the tray using a suitably thin plastic, as it is appreciated that thermoformed thin sheets are usually resiliently deformable to some degree. When inserting the ammunition, the extending portion 116 may be forced laterally (with respect to the longitudinal axis of the ammunition) away from the compartment 115, so as to allow the entire circumference of the ammunition access into the compartment 115 (this corresponds to a rightward movement of an extending portion 116 as seen in FIGS. 4 and 6, for example). Likewise, during removal of ammunition, the extending portion 116 may be deflected laterally to allow the entire circumference of the ammunition to be pulled out of the compartment 115.

In the embodiments shown, the securing portion 113*b* occupies about ⅓ of the total length of the wall 113, and is positioned in the middle thereof, with separating portions 113*a* on either side thereof. The securing portion 113*b* also could be configured to include any length from none to all of the length of the wall 113, and could be positioned anywhere there-along (for example, the middle as shown, or rearward, frontward, etc.), depending on the particular type of ammunition sought to be packaged. Further, the securing portion 113*b* may comprise more than one such portion along the length of wall 113, in effect including multiple securing tabs built into the wall 113. The length of the securing portion(s) 113*b* may be selected in combination with the thickness of the sheet stock to balance the resilient force resisting insertion when the package is loaded and then holding the ammunition in the compartment against the desire that such force not impair easy deflection of the securing portion 113*b* when ammunition removal is desired. Typically, a lifting force applied by a fingertip or fingertip pair at the rim 4 should be sufficient to deflect and overcome the securing force of resilient securing portion 113*b* and allow unit removal.

With particular attention to the front and rear interior walls 124*a*, 124*b*, such walls may be provided so as to limit the axial movement of the ammunition within the compartment 115. As such, the walls 124*a* and 124*b*, in some embodiments, may be flat and continuous along their length, providing protection to the tip and base of the ammunition. As discussed above, however, certain key areas of the ammunition may benefit from additional protection to ensure that they will be free from damage. Some of these areas may be located at ends of the ammunition (e.g., the projectile/casing connection point, the loading means, and the ignition means—with reference to FIG. 9, these areas are the bullet 1/casing 2 connection point, the rim 4, and the area in and around the primer 5). Thus, areas of the compartment 115 abutting such ends where there are key areas located may have features that provide protection beyond just the lateral separation of the casing separation wall 113.

Figure 2:
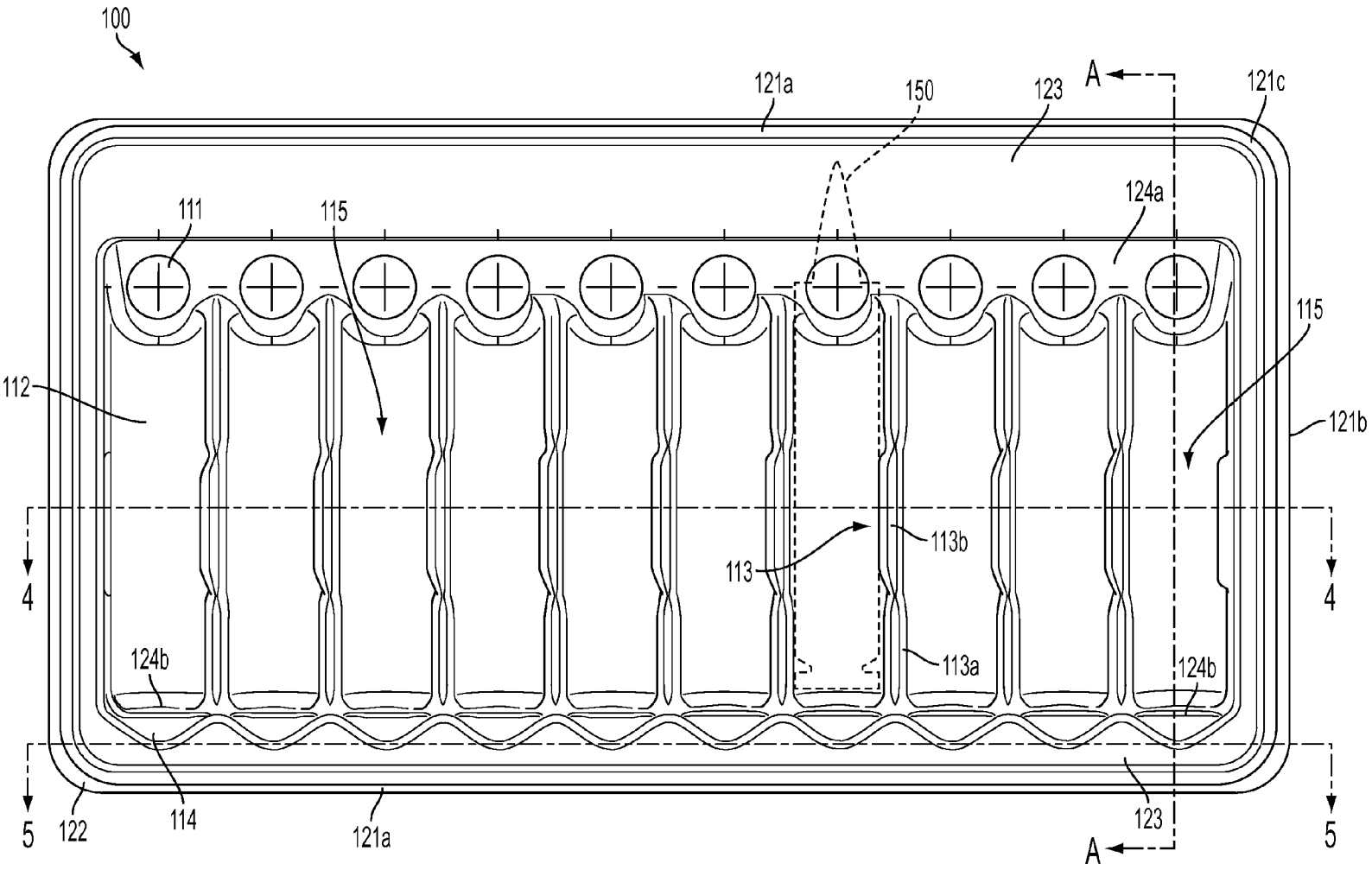
FIG. 2 is a top plan view of the ammunition packaging embodiment of FIG. 1.

A first key area protection portion 111 is provided along front interior wall 124*a*. This protection portion 111 is embodied in the Figures as an aperture providing access to a tip cavity 125 located under that portion of the planar peripheral surface 123 adjacent the front interior wall 124*a*. The cavity is further bounded by the front wall 121*a* and a portion of both walls 121*b* (except in such embodiments where walls 121*a* and 121*b* are not provided). In one embodiment, apertures are cut out of the front interior wall 124*a* (ten holes being shown in the Figures corresponding to ten ammunition compartments 115). The aperture may be sized and shaped so as to allow insertion during package loading of the projectile portion of the ammunition, e.g., the bullet, and thereby secure such projectile at or near the connection point with the casing and allow it to extend into tip cavity 125. The body of the projectile is not within the compartment 115, but rather extends into a tip cavity 125 beneath the planar peripheral surface 123, as best shown in FIGS. 2-3. (FIG. 3 shows in phantom lines an inserted cartridge 150.) The shape and sizing of the protection portion 111 aperture may be configured to provide a relatively snug fit around the perimeter of the projectile, to prevent or limit its movement without making removal difficult or impairing projectile shape. Furthermore, in some embodiments, the interior wall 124*a* may be provided at an angle that is preferably between about 30 degrees and 60 degrees with respect to the upper peripheral surface 123, or more preferably between about 40 and 50 degrees with respect to the surface 123, so as to contact the projectile not only around its entire perimeter, but also at multiple locations along its axial length. In these embodiments, assuming a projectile with a circular, vertical cross-section, the shape of the aperture 111 will be oval, so that the perimeter thereof remains in even and snug contact with the circular cross-section projectile (i.e., the angle of the wall causes the aperture 111 to skew axially with respect to the projectile, and thus an oval or ovoid shape (corresponding to a tilted frustum of the cone of the projectile) is required to maintain the snug and even fit therebetween). Thus, the aperture 111 when viewed along the elongation axis of an inserted ammunition unit will appear generally circular. This configuration allows the projectile to be secured by the tray at its key area connection point with the casing, rather than at the tip thereof, because contact between the tray and the tip could result in incident forces at the key area that could damage the ammunition. In this manner, the key area of the connection point between the projectile and the casing is provided a greater degree of protection from damage (i.e., is secured in place to a greater degree and protected from a force that might be introduced at the projectile tip and stress the connection point between the projectile 1 and the casing 2). Placing the projectile into tip cavity 125 beneath the planar peripheral surface 123 also provides protection for the shape of the projectile.

A second key area protection portion is provided along the rear interior wall 124*b*. This protection portion is embodied (and shown in the Figures) as a recessed, inclined portion 114 formed in rear interior wall 124*b*. This second key area protection portion is provided to protect the key areas of the ammunition that may be located near the base of the casing 2, for example the rim 4 and the area in and around the primer 5 with reference to the example of FIG. 9. As will be appreciated, to prevent damage during transportation, the compartment 115 should be in supporting contact with the base of the casing 2 where such key areas are located to provide protection thereto. However, in tray configurations where the projectile portion is inserted into a snug-fitting first securing portion (as in the Figures), the length of the compartment would have to be slightly longer than the cartridge itself to allow the base end of the cartridge to be lowered into position after the projectile end is inserted into the aperture 111, due to the geometry of the projectile, in order to avoid damaging the tray by bending it outwardly to "squeeze" the cartridge into place. Such additional length, although slight, might result in some axial movement of the cartridge back and forth within the width of the tray. This movement would have the detrimental effects of not only losing the snug connection with the projectile portion in the aperture 111, but also bumping of the base end key areas with the rear interior wall 124*b*. Thus, in order to solve this potential problem a second key area protection portion is provided as a recessed portion 114. This recessed portion 114 allows the extra room required when lowering the base end of the ammunition into place (while inserting the projectile into the first securing portion 111). The rear interior wall 124*b* is then able to remain in snug association with the base end of the inserted ammunition, protecting any key areas located thereat. The ammunition may be guidedly inserted into the compartment without the need to deform substantially the tray at a portion thereof adjacent to the base portion of the ammunition when inserted. Further protection to the base end is provided by virtue of the side wall 121*a* which runs parallel to the rear interior wall 124*b*, thereby resulting in "double-walled" protection.

Figure 10:
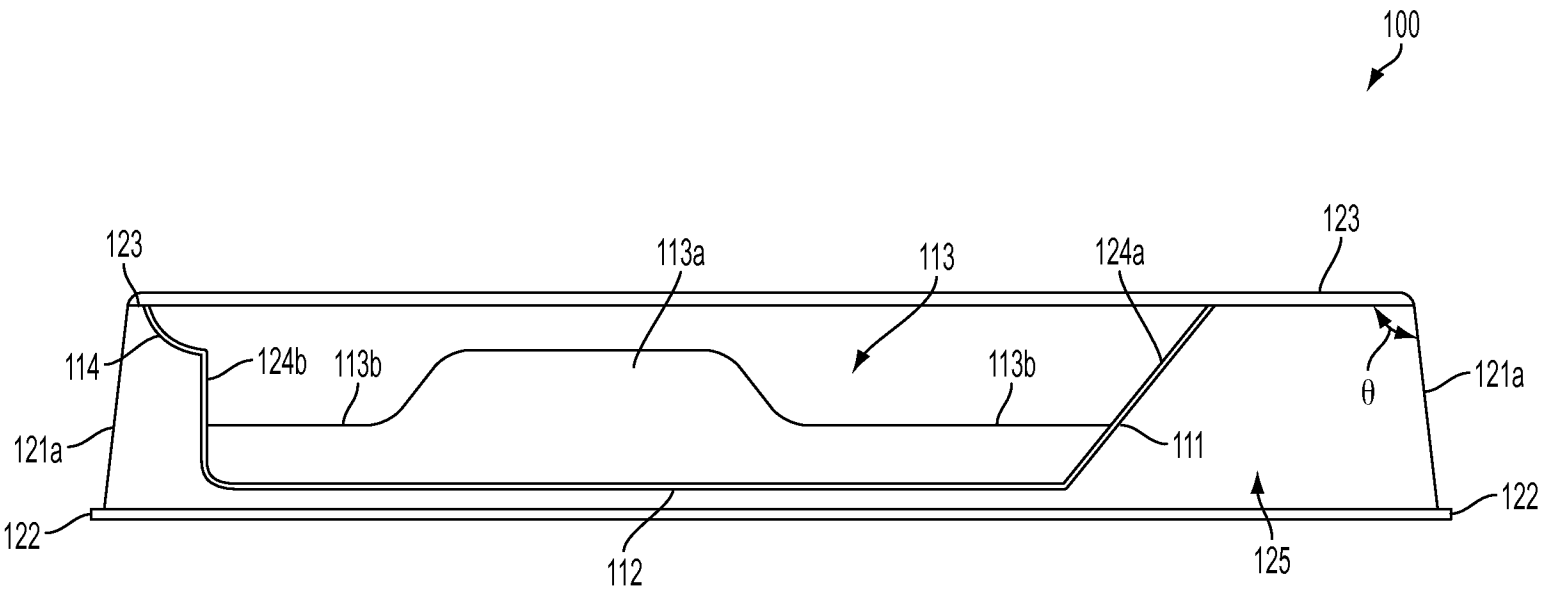
FIG. 10 is an example cross-sectional view of the ammunition package of FIG. 2 taken along line A-A of FIG. 2.

As shown best in FIGS. 5 and 10, the recessed portions 114 in one embodiment may be generally curved in shape, may incline downward toward the bottom of the compartment 115, and may reach a maximum depth anywhere between about ⅕ to ½ the depth of the compartment 115 below the surface 123. Preferably, the depth is about ⅓ the depth of the compartment 115, as shown. FIG. 10 shows the recessed portion 114 from a side view, and further illustrates the separation walls 113, including the separating portion 113*a* and the securing portion 113*b*. Of course, the portions 114 need not be curved, but could also be rectangular or any other shape suitable to accommodate and assist the guided insertion of the particular ammunition desired to be packaged. Furthermore, the recessed portion 114 may facilitate and guide insertion by centering the base end of a cartridge during insertion and may allow for easier removal of the ammunition from the trays, for example, by leaving a small area of access for the user's finger(s) to grasp the base of the ammunition and lift it upward and out of the tray. The application of a lifting motion at the base is also facilitated by the low height of the separation walls 113 adjacent where the cartridge base will lie.

Figure 8:
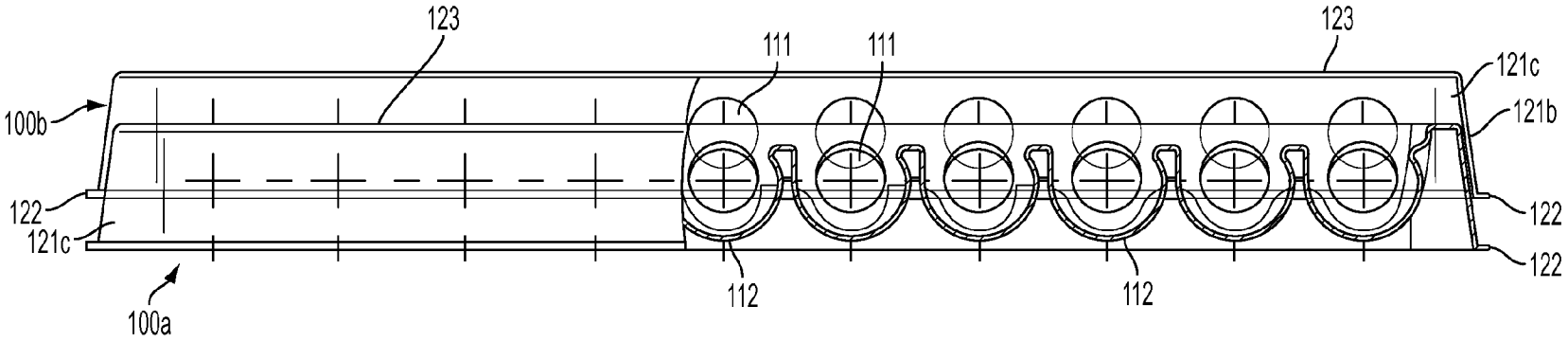
FIG. 8 depicts a nested configuration of two ammunition packages in accordance with the present disclosure.

With reference to FIG. 8, two ammunition packaging trays 100*a*, 100*b* are shown nested together in an empty configuration (without ammunition). This nesting is possible due to the relationship between the walls 121*a*, 121*b* and the upper peripheral surface 123, which are provided at an angle that is slightly greater than perpendicular, as discussed above. This configuration allows empty trays to nest on top of one another. The benefits of such feature will be realized in the manufacture and shipment of such trays to their end users, allowing the empty trays to be stacked at manufacture and delivered in stack that takes up less volume than without such nesting, thereby requiring less storage space, smaller shipping containers, and resulting in possibly reduced costs. The feature may also provide size benefits for stacking trays filled with ammunition. When two filled trays are stacked, unless the ammunition is unusually large in diameter, some nesting of trays is still possible, such that the height of two stacked filled trays may be less than or equal to two times the basic height dimension of an individual tray.

In use, the thermoformed trays 100 as disclosed herein may be provided in connection with either a box (e.g., cardboard or paper board) or a covering blister (or two enclosing blisters, i.e., a trapping, clamshell configuration) to complete the packaging (i.e., to fully enclose the tray). Where a plastic blister is provided to enclose the tray, sealing means, such as adhesives, hot melt, or RF (radio frequency) sealing may be provided to join a covering blister to a tray 100 at its periphery or to join two blisters in a clamshell containing a tray 110, to ensure a secure packaged enclosure. Further, where a covering plastic blister is provided, the peripheral flange 122 may be used to support the blister over the tray in position prior to application of the sealing. Of course, a combination of both a box (or other form of outer carton) and a blister (or two mating, enclosing blisters) may be provided to complete the enclosure of the tray/ammunition.

It is further contemplated that the sheet stock and resulting trays may be made of any material suitable for use in thermoforming operations. These include, but are not limited to, PET, PVC, HIPS, HDPE, any other thermoplastic extrudable resin or bioplastics (PLA, plastics from organic feedstocks or waste materials). Such materials may be substantially transparent, wherein the contents of the tray are visible therethrough. Alternatively, the material may be a non-transparent plastic. Various colors and printed design are also possible, which will be appreciated as allowing for enhanced branding capability. The planar peripheral surface 123 may provide additional branding capabilities, by printing or a thermoformed embossment.

A typical thickness of the plastic sheet stock material used for the present packaging is about 0.005 to 0.080 inches or about 0.0127 to 0.2032 mm or about 0.0125 to 0.205 mm. One benefit of this material is that, once thermoformed in a configuration as shown, the formed unit remains somewhat deformable. This facilitates loading and removal, where a small amount of flex at some surfaces of contact between cartridge and packaging may be useful, i.e., at the securing portion 113*b*, when the cartridge must move under, or be removed from under, the overhanging or extending portion 116. It further provides the packaging with some resilience that may cushion the inserted cartridges when the entire package is subject to G-forces in handling, as when a box of packaged cartridges is dropped.

As described herein, the thermoformed ammunition packaging of the present disclosure will realize various benefits over packaging currently known in the art. Thermoforming allows for the use of lightweight materials, which reduce the overall weight of the packaging and thereby saves money and material in connection with ammunition shipping and transportation. Thermoforming allows for the use of recycled and recyclable materials, including excess materials resultant from the production process, thereby resulting in a more environmentally friendly product. The plastic materials used may be transparent, which allows for greater clarity/visibility of the product and enhanced branding. Thermoformed plastic packaging allows for greater security of the ammunition, as traditional cardboard or paperboard boxes are relatively easy to tear open, whereas thermoformed plastic is more difficult to tear or otherwise tamper with, especially where a blister is sealed over the tray to complete the enclosure. Thermoformed plastic packaging when in a sealed blister configuration also provides the benefit of moisture protection for the packaged ammunition, which traditional paperboard packaging cannot provide. As will be appreciated, the ammunition propellant may be susceptible to moisture degradation, and therefore it is desirable to reduce the ammunition's exposure to moisture as much as possible.

Second Embodiment

Figure 11A:
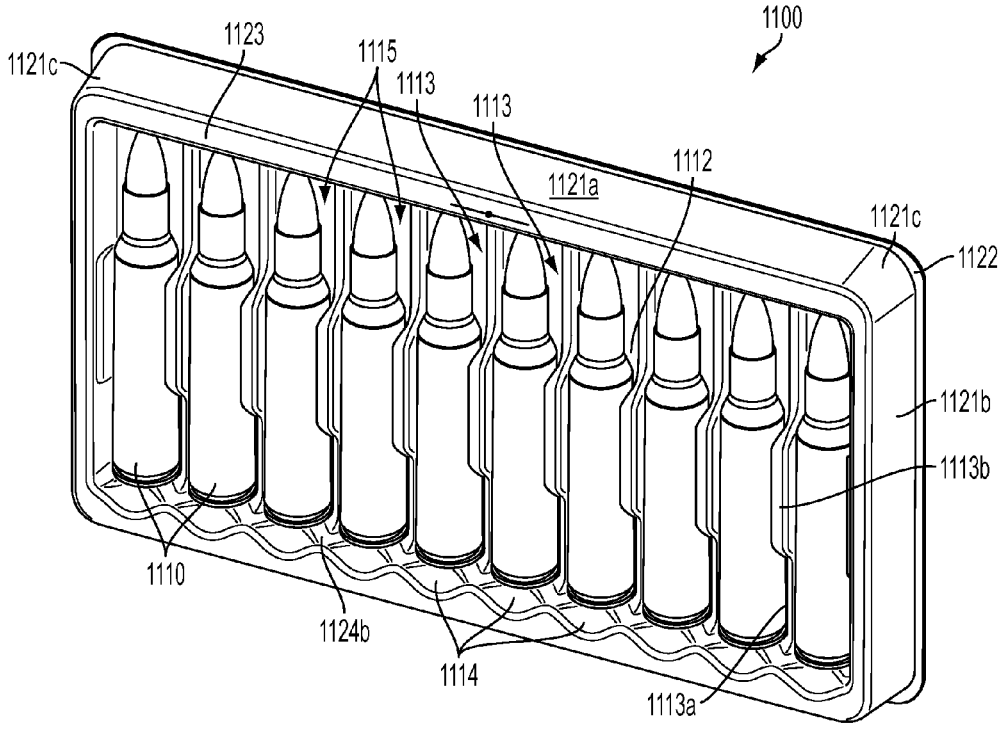
FIGS. 11*a*-11*e* are various views of an alternative embodiment of the ammunition packaging in accordance with the present disclosure, including, respectively, a perspective view, a rear side view, an end side view, a top plan view with ammunition inserted and a bottom plan view.
Figure 11B:
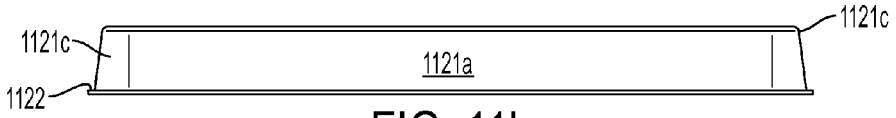
Figure 11C:
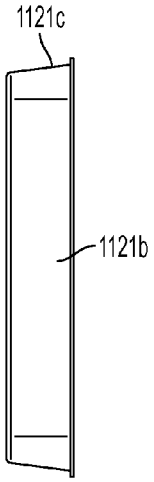

With reference now to an alternative embodiment of the invention, disclosed in FIGS. 11*a*-11*e* is another thermoformed protective packaging tray 1100 for use in packaging ammunition, in particular, ammunition units comprising elongated cartridges. As with the tray of FIGS. 1-7, the tray may be generally rectangular in shape, having a length, width, and height. However, this tray 1100 is unlike that of FIGS. 1-7, because there is no aperture 111 or tip cavity, as will be explained below. As seen best in the perspective and plan views (FIGS. 11*a* and 11*d*), the packaging tray 1100 may include a substantially planar upper peripheral surface 1123 that extends about peripheral portions of the top face of the packaging tray 1100. At the outer perimeter of the upper peripheral surface 1123 four walls may be connected. The two length-wise side walls 1121*a* may be connected to the two width-wise end walls 1121*b* at rounded corners 1121*c* (four rounded corners 1121*c* appear in the rectangular embodiment shown). Referring now also to FIGS. 11*b* and 11*c*, the walls 1121*a*, 1121*b* are connected to the upper peripheral surface 1123 at an angle that is slightly greater than perpendicular, for example, generally between about 95 degrees and 120 degrees. This off-perpendicular connection between the upper peripheral surface 1123 and the walls 1121*a*, 1121*b* allows for closer nesting of multiple empty trays on top of one another, as with the prior embodiments. A peripheral flange 1122 (narrow, as shown, but wider in other embodiments) will typically be connected to the walls 1121*a*, 1121*b* at the lower edges thereof, opposite the connection with the upper peripheral surface 1123 (i.e., the lower rim of the package) as an artifact of the thermoforming process or as a matter of design. (As described above, such flange 1122 may be used to add wall strength or to provide support for a blister or other enclosure to be provided with the tray, and sealed thereto, to complete the packaging). In some embodiments, however, one or more of walls 1121*a* and 1121*b* need not be included on the tray 1100.

Figure 11D:
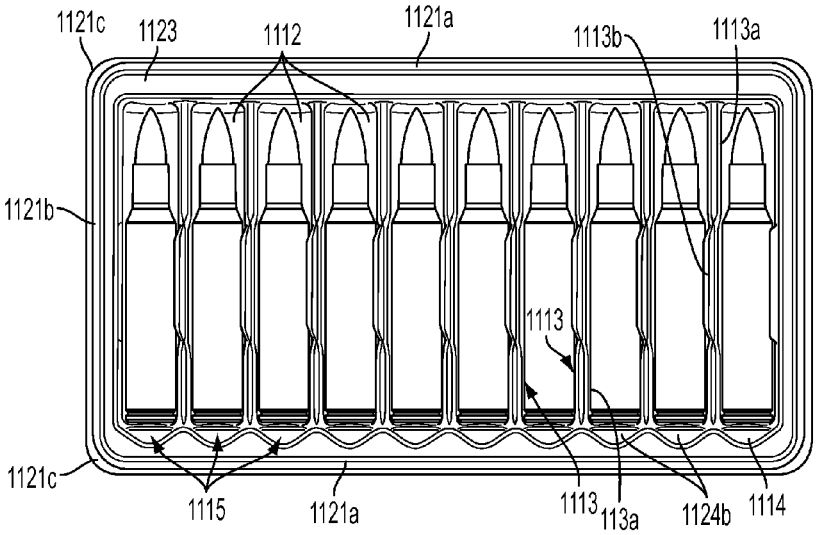

While a rectangular-shaped tray is shown in the embodiment of FIGS. 11*a*-11*g*, it should be appreciated that the tray is not limited to rectangular forms, or to rectangular forms with dimensions substantially as shown. Rather, other shapes are presently contemplated, including square, circular, oval, ovoid, triangular, polygonal, and others. Further, a wide range of tray thicknesses (height of the walls 1121*a*, 1121*b*) is contemplated. In choosing a particular shape and size, it is contemplated that the type and number of cartridges sought to be packaged will determine the dimensions employed. In the example depicted in the FIGS. 11*a*-11*g*, the length of the tray 1100 is determined by the number of cartridges sought to be packaged and such cartridges' width or diameter (as a multiple thereof), the width of the tray is determined by the length of the cartridge, and the height of the tray is determined by the width or diameter of the ammunition. In particular, the ammunition units may be elongated cartridges as shown in FIGS. 11*a*, 11*d*.

Referring to FIGS. 11*a* and 11*d*, recessed downwardly from the plane of the upper peripheral surface 1123, and situated inwardly therefrom, are provided a plurality of ammunition storage compartments 1115. As shown in the FIGS. 11*a*, 11*d*, ten ammunition storage compartments 1115 are provided in this example embodiment, enabling ten cartridges to be stored in the packaging tray 1100. Each ammunition storage compartment 1115 is elongated, extending between the generally opposed pair of walls 1121*a* and defined on the bottom side thereof by an ammunition supporting or cradling surface 1112, on lateral sides thereof by ammunition separating walls 1113, and on the rear side thereof by a rear interior wall 1124*b*. The elongated configuration is useful for ammunition such as cartridges, which have a generally elongated shape. However, compartments may be shaped so as to accommodate whatever ammunition type is being packaged.

With particular attention to ammunition cradling surfaces 1112, such surfaces may be provided in a shape to substantially match a portion of the shape of the ammunition sought to be packaged. In the example embodiment shown in FIGS. 11*a*-11*g*, where, as previously mentioned, the desired ammunition is cartridges, the ammunition cradling surfaces 1112 are curved to substantially match the curvature of the casing. In this manner, the casing is supported in place through direct contact, on its bottom side (i.e., the ammunition is "cradled"), with a curved cradling surface 1112. Each compartment 1115 is provided with such a surface 1112. Other cradling surface 1112 shapes may be required where the ammunition is of different shape, e.g., flat, angled, irregular, etc. The cradling surface may be continuous as shown or have interruptions or apertures (not shown).

Figure 11E:
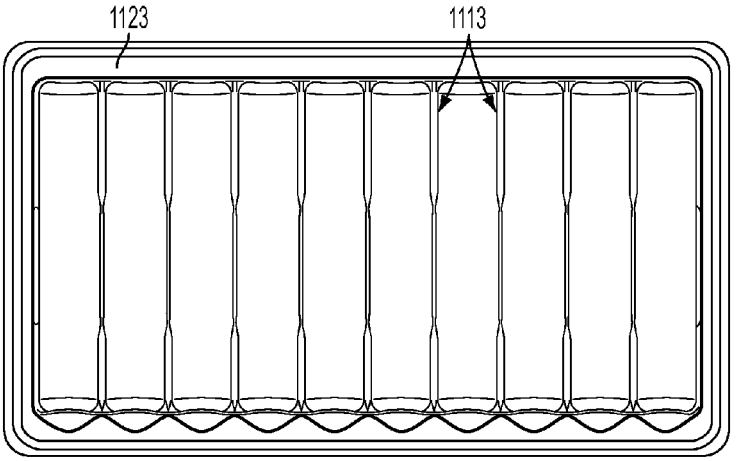

With particular attention to ammunition separating walls 1113, such walls may be provided to ensure separation between each ammunition unit so that the ammunition unit does not come in contact with the adjacent unit during shipping and transportation. As shown, the thickness of separating walls 1113 is relatively small, for example, less than about 25% of the width of the compartments 1115. This allows the ammunition to be "dense-packed" within the tray (thus reducing the needed size of the tray and the needed amount of material), while still maintaining adequate separation between the ammunition. The walls 1113 are arranged parallel to one another and are generally straight, in order to accommodate cartridges which are generally continuous and straight along their casing length. However, non-parallel or non-straight walls 1113 may be provided where the shape of the enclosed ammunition so dictates. Separating walls 1113 can be formed as molded bends in the thermoform sheet, resulting in a cavity, negative space or relief therebeneath (as shown in FIG. 11*e*). Alternatively, the package may be formed from two separately-formed thermoformed components. One may be a base thermoformed component, with the overall structure but without certain detail features, which are made in a second, thermoformed insert component that may be fitted into or onto a portion of the base thermoformed component. For example, separating walls 1113 may be formed as a separate transverse strip, and by inserting this additional strip into the base thermoformed component after it has been thermoformed. The strip is configured for a friction fit into or onto the base thermoformed component, such that its features are added at specific locations in the base thermoformed component.

In some embodiments, the walls 1113 may include two or more portions. A first portion 1113*a*, which may be referred to as a separating portion, and a second portion 1113*b*, which may be referred to as a securing portion. Whereas portion 1113*a* generally serves to separate adjacent ammunition units from one another, as described above, securing portion 1113*b* not only serves a separation purpose, but also a securing purpose with respect to the ammunition. As was explained above for the embodiment of FIGS. 1-7, securing portion 1113*b* includes an extending portion configured as an overhanging tab that extends somewhat over the compartment 1115, and is contoured to match the contour of the cartridge casing, thus resulting in an area of contact therebetween. Alternatively, the overhanging tab may be contoured to provide only a tangent line of contact. This extending portion includes an undercut geometry that protrudes over the top of the lateral tangent point of the cartridge on one side thereof. On the other side of compartment 1115, opposite the extending portion on the securing portion 1113*b* is a generally vertical wall, which serves to hold the cartridge in place with reference to the extending portion. In embodiments where the walls 1113 are formed by a molded bend in the thermoform sheet, the overhanging tab of the extending portion is formed by broadening the cavity under the bend, relative to the amount of separation between the ascending and descending portions of the sheet leading to the bend.

Thus, the supporting or cradling surface 1112 and the securing portion 1113*b*, are essentially the same as in the embodiment of FIGS. 1-7. As such, the secured cartridge will not be free to move easily in any direction normal to its longitudinal axis when positioned within the compartment 1115, and, in order to more easily inserted or remove the ammunition, the extending portion may be resiliently deformable.

As with the prior embodiment shown, the securing portion 1113*b* occupies a fraction (here about ⅕ to ⅓) of the total length of the wall 1113, and is positioned in the middle thereof, with separating portions 1113*a* on either side thereof. The length of the securing portion(s) 1113*b* may be selected in combination with the thickness of the sheet stock to balance the resilient force resisting insertion when the package is loaded and then holding the ammunition in the compartment against the desire that such force not impair easy deflection of the securing portion 1113*b* when removal is desired.

As discussed above for FIGS. 1-7, certain key areas of the ammunition may benefit from additional protection to ensure that they will be free from damage. Some of these areas may be located at ends of the ammunition (e.g., the projectile/casing connection point, the loading means, and the ignition means—with reference to FIG. 9, these areas are the bullet 1/casing 2 connection point, the rim 4, and the area in and around the primer 5). Thus, areas of the compartment 1115 abutting such ends where there are key areas located may have features that provide protection beyond just the lateral separation of the casing separation wall 1113.

A first key area protection portion in the embodiment of tray 1100 is not formed with an aperture providing access to a tip cavity 125 but rather by an extension of the length of ammunition compartments 1115. The body of the projectile is within the extended compartment 1115, as best shown in FIGS. 11*a*, 11*d*. Placing the projectile into extended compartment 1115 also provides protection for the shape of the projectile.

A second key area protection portion is provided along the rear interior wall 1124*b*. This protection portion is a recessed, inclined portion 1114 formed in rear interior wall 1124*b*. This second key area protection portion is provided to protect the key areas of the ammunition that may be located near the base of the casing 2, for example the rim 4 and the area in and around the primer 5 (see FIG. 9) just as in the embodiment of FIGS. 1-7. This recessed portion 1114 allows the extra room required when lowering the base end of the ammunition into place. The rear interior wall 1124*b* is then able to remain in snug association with the base end of the inserted ammunition, protecting any key areas located thereat. The ammunition may be guidedly inserted into the compartment without the need to deform substantially the tray at a portion thereof adjacent to the base portion of the ammunition when inserted. Further protection to the base end is provided by virtue of the side wall 1121*a* which runs parallel to the rear interior wall 124*b*, thereby resulting in "double-walled" protection.

In use, the thermoformed trays 1100 as disclosed herein may be provided in connection with either a box (e.g., cardboard or paper board) or a covering blister (or two enclosing blisters, i.e., a trapping, clamshell configuration) to complete the packaging (i.e., to fully enclose the tray and provide further protection for the ammunition). Where a plastic blister is provided to enclose the tray, sealing means, such as adhesives, hot melt, or RF (radio frequency) sealing may be provided to join a covering blister to a tray 1100 at its periphery or to join two blisters in a clamshell containing a tray 1110, to ensure a secure packaged enclosure. Further, where a covering plastic blister is provided, it may have peripheral side sloping down from a covering surface that mate with opposed lengthwise sides 1121*a* and 1121*b*, and the peripheral flange 1122 may be used to support the blister over the tray in position prior to application of the sealing. Of course, a combination of both a box (or other form of outer carton) and a blister (or two mating, enclosing blisters) may be provided to complete the enclosure of the tray/ammunition.

Third Embodiment

Figure 12A:
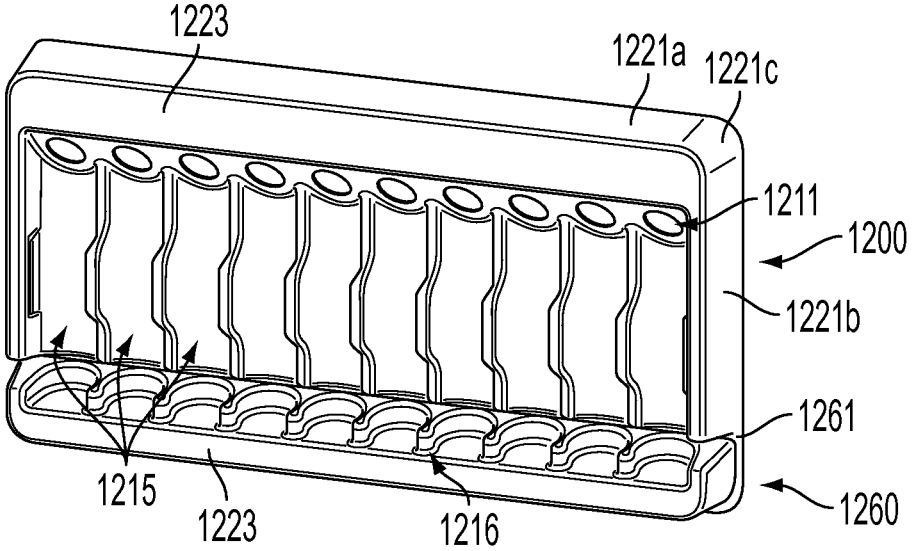
FIGS. 12*a*-*i* are various views of a further alternative embodiment of ammunition packaging in accordance with the present disclosure, including, respectively, a perspective view with a hinged retaining side wall closed (FIG. 12*a*), a perspective view with the hinged retaining side wall opened (FIG. 12*b*), a rear side view (FIG. 12*c*), an end view with the hinged retaining wall closed (FIG. 12*d*), an end view with the hinged retaining wall opened (FIG. 12*e*), a top plan view (FIG. 12*f*), a bottom plan view (FIG. 12*g*), a cross-sectional side view taken at line Y-Y of FIG. 12*g* (FIG. 12*h*) and a detail view taken from the circled portion of FIG. 12*h* (FIG. 12*i*).
Figure 12B:
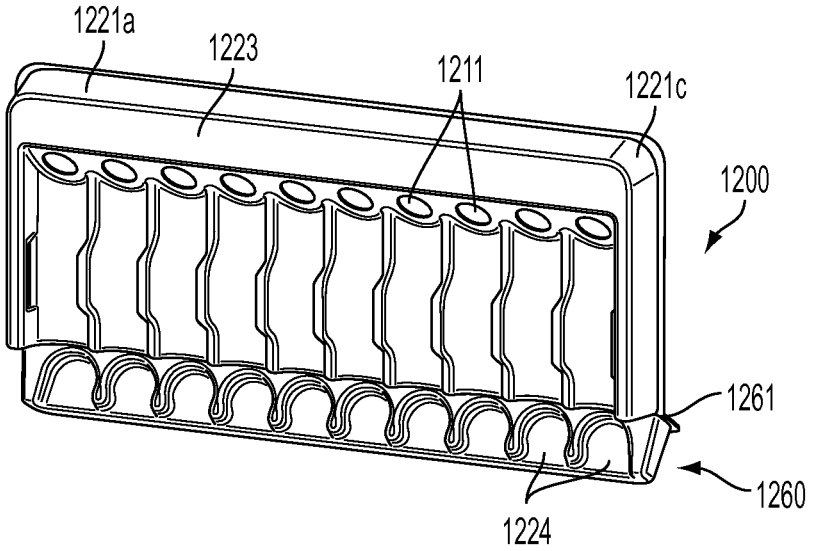
Figure 12C:
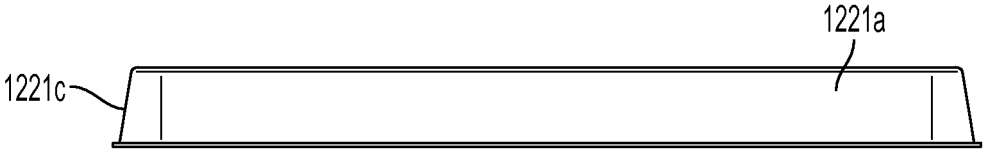
Figure 12D:
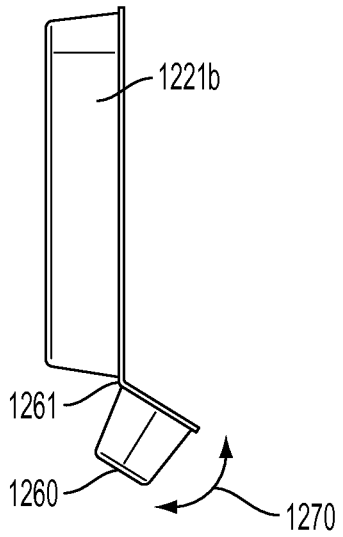
Figure 12E:
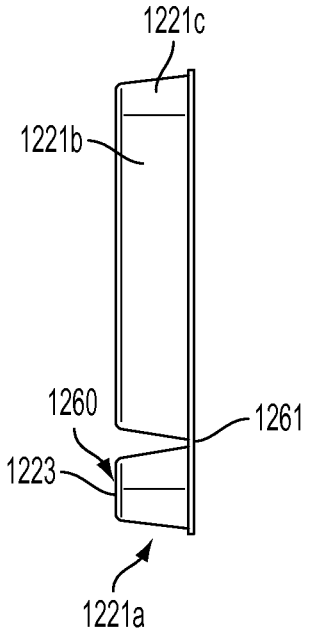

With reference now to another alternative embodiment of the invention, disclosed in FIGS. 12*a*-12*i* is another thermoformed protective packaging tray 1200 for use in packaging ammunition, in particular, ammunition units comprising elongated cartridges. As with the tray of FIGS. 1-7, the tray may be generally rectangular in shape, having a length, width, and height. However, this tray 1200 is unlike that of FIGS. 1-7, because it has a hinged side wall feature, as will be explained below. As seen best in the perspective and plan views (FIGS. 12*a*, 12*b*, and 12*f*), the packaging tray 1200 may include a substantially planar upper peripheral surface 1223 that extends about peripheral portions of the top face of the packaging tray 1200. At the outer perimeter of the upper peripheral surface 1223 four walls may be connected. The two length-wise, opposed side walls 1221*a* may be connected to the two width-wise, opposed end walls 1221*b* at rounded corners 1221*c* (four rounded corners 1221*c* appear in the rectangular embodiment shown). Referring now also to FIGS. 12*c*, 12*d*, and 12*e*, the walls 1221*a*, 1221*b* are connected to the upper peripheral surface 1223 at an angle that is slightly greater than perpendicular, for example, generally between about 95 degrees and 120 degrees. This off-perpendicular connection between the upper peripheral surface 1223 and the walls 1221*a*, 1221*b* allows for closer nesting of multiple empty trays on top of one another, as with the prior embodiments. A peripheral flange 1222 (narrow, as shown, but wider in other embodiments) will typically be connected to the walls 1221*a*, 1221*b* at the lower edges thereof, opposite the connection with the upper peripheral surface 1223 (i.e., the lower rim of the package) as an artifact of the thermoforming process or as a matter of design. (As described above, such flange 1222 may be used to add wall strength or to provide support for a blister or other enclosure to be provided with the tray, and sealed thereto, to complete the packaging). In some embodiments, however, one or more of walls 1221*a* and 1221*b* need not be included on the tray 1200.

While a rectangular-shaped tray is shown in the embodiment of FIGS. 12*a*-12*i*, it should be appreciated that the tray is not limited to rectangular forms, or to rectangular forms with dimensions substantially as shown. Rather, other shapes are presently contemplated, including square, circular, oval, ovoid, triangular, polygonal, and others. Further, a wide range of tray thicknesses (height of the walls 1221*a*, 1221*b*) is contemplated. In choosing a particular shape and size, it is contemplated that the type and number of cartridges sought to be packaged will determine the dimensions employed. In the example depicted in the FIGS. 12*a*-12*i*, the length of the tray 1200 is determined by the number of cartridges sought to be packaged and such cartridges' width or diameter (as a multiple thereof), the width of the tray is determined by the length of the cartridge, and the height of the tray is determined by the width or diameter of the ammunition. In particular, the ammunition units may be elongated cartridges.

Figure 12F:
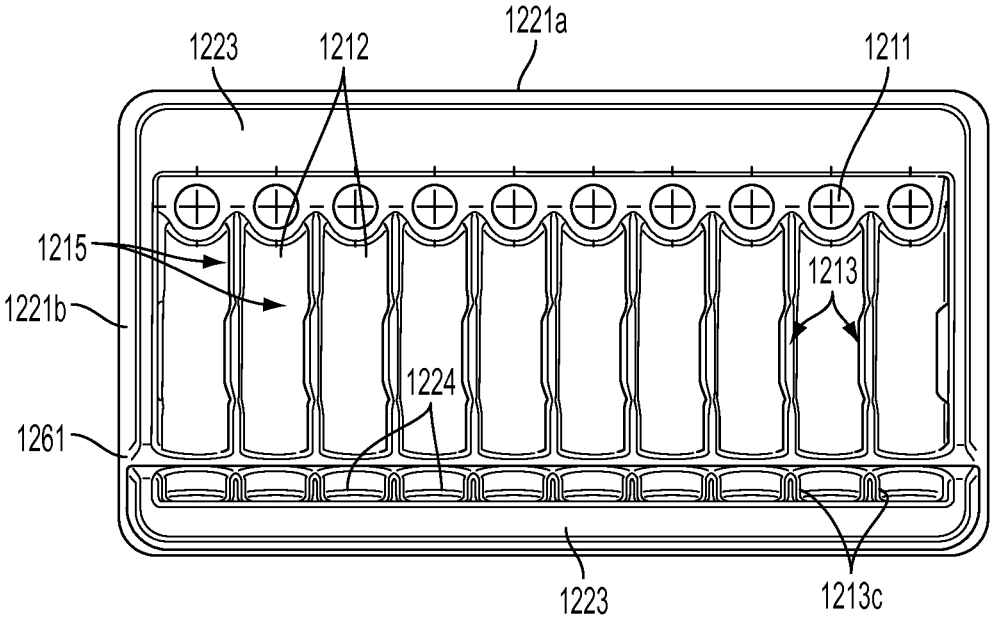

Referring to FIGS. 12*a*, 12*b* and 12*f*, recessed downwardly from the plane of the upper peripheral surface 1223, and situated inwardly therefrom, are provided a plurality of ammunition storage compartments 1215. As shown in the FIGS. 12*a*, 12*b*, and 12*f*, ten ammunition storage compartments 1215 are provided in this example embodiment, enabling ten cartridges to be stored in the packaging tray 1200. Each ammunition storage compartment 1215 is elongated, extending between the generally opposed pair of walls 1221*a* and defined on the bottom side thereof by an ammunition supporting or cradling surface 1212, on lateral sides thereof by ammunition separating walls 1213, and on the rear side thereof by a rear interior wall 1224*b*. The elongated configuration is useful for ammunition such as cartridges, which have a generally elongated shape. However, compartments may be shaped so as to accommodate whatever ammunition type is being packaged.

With particular attention to ammunition cradling surfaces 1212, such surfaces may be provided in a shape to substantially match a portion of the shape of the ammunition sought to be packaged. In the example embodiment shown in FIGS. 12*a*-12*i*, where, as previously mentioned, the desired ammunition is cartridges, the ammunition cradling surfaces 1212 are curved to substantially match the curvature of the casing. In this manner, the casing is supported in place through direct contact, on its bottom side (i.e., the ammunition is "cradled"), with a curved cradling surface 1212. Each compartment 1215 is provided with such a surface 1212. Other cradling surface 1212 shapes may be required where the ammunition is of different shape, e.g., flat, angled, irregular, etc. The cradling surface may be continuous as shown or have interruptions or apertures (not shown).

Figure 12G:
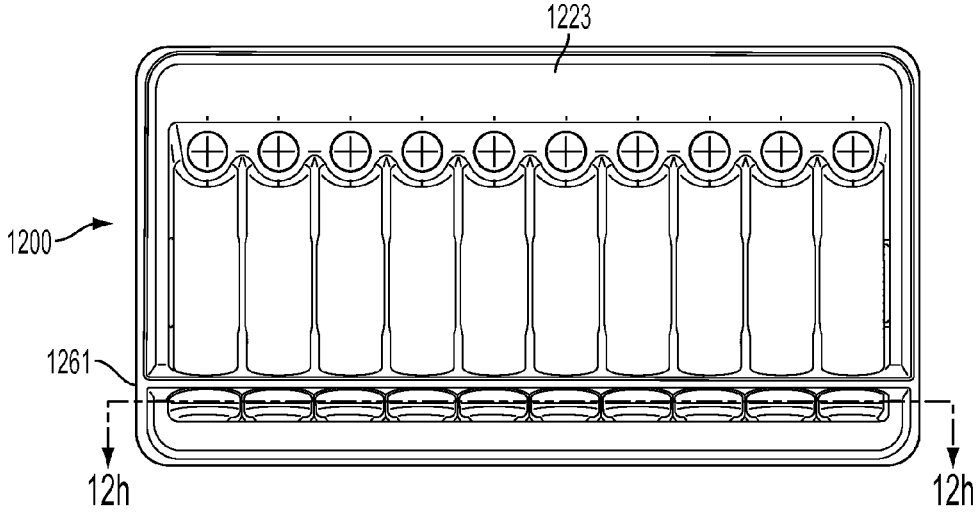

With particular attention to ammunition separating walls 1213, such walls may be provided to ensure separation between each ammunition unit so that the ammunition unit does not come in contact with the adjacent unit during shipping and transportation. As shown, the thickness of separating walls 1213 is relatively small, for example, less than about 25% of the width of the compartments 1215. This allows the ammunition to be "dense-packed" within the tray (thus reducing the needed size of the tray and the needed amount of material), while still maintaining adequate separation between the ammunition. The walls 1213 are arranged parallel to one another and are generally straight, in order to accommodate cartridges which are generally continuous and straight along their casing length. However, non-parallel or non-straight walls 1213 may be provided where the shape of the enclosed ammunition so dictates. Separating walls 1213 can be formed as molded bends in the thermoform sheet, resulting in a cavity, negative space or relief therebeneath (as shown in FIG. 12*g*). Alternatively, the package may be formed from two separately-formed thermoformed components. One may be a base thermoformed component, with the overall structure but without certain detail features, which are made in a second, thermoformed insert component that may be fitted into or onto a portion of the base thermoformed component. For example, separating walls 1213 may be formed as a separate transverse strip, and by inserting this additional strip into the base thermoformed component after it has been thermoformed. The strip is configured for a friction fit into or onto the base thermoformed component, such that its features are added at specific locations in the base thermoformed component.

In some embodiments, the walls 1213 may include two or more portions. A first portion 1213*a*, which may be referred to as a separating portion, and a second portion 1213*b*, which may be referred to as a securing portion. Whereas portion 1213*a* generally serves to separate adjacent ammunition units from one another, as described above, securing portion 1213*b* not only serves a separation purpose, but also a securing purpose with respect to the ammunition. As was explained above for the embodiment of FIGS. 1-7 for a comparable structure, securing portion 1213*b* includes an extending portion configured as an overhanging tab that extends somewhat over the compartment 1215, and is contoured to match the contour of the cartridge casing, thus resulting in an area of contact therebetween. Alternatively, the overhanging tab may be contoured to provide only a tangent line of contact. This extending portion includes an undercut geometry that protrudes over the top of the lateral tangent point of the cartridge on one side thereof. On the other side of compartment 1215, opposite the extending portion on the securing portion 1213*b* is a generally vertical wall, which serves to hold the cartridge in place with reference to the extending portion. In embodiments where the walls 1213 are formed by a molded bend in the thermoform sheet, the overhanging tab of the extending portion is formed by broadening the cavity under the bend, relative to the amount of separation between the ascending and descending portions of the sheet leading to the bend.

Thus, the supporting or cradling surface 1212 and the securing portion 1213*b*, are essentially the same as in the embodiment of FIGS. 1-7. As such, the secured cartridge will not be free to move easily in any direction normal to its longitudinal axis when positioned within the compartment 1215, and, in order to more easily inserted or remove the ammunition, the extending portion may be resiliently deformable.

As with the prior embodiments shown, the securing portion 1213*b* occupies about ⅓ of the total length of the wall 1213, and is positioned in the middle thereof, with separating portions 1213*a* on either side thereof. The length of the securing portion(s) 1213*b* may be selected in combination with the thickness of the sheet stock to balance the resilient force resisting insertion when the package is loaded and then holding the ammunition in the compartment against the desire that such force not impair easy deflection of the securing portion 1213*b* when removal is desired.

As discussed above for FIGS. 1-7, certain key areas of the ammunition may benefit from additional protection to ensure that they will be free from damage. Some of these areas may be located at ends of the ammunition (e.g., the projectile/casing connection point, the loading means, and the ignition means—with reference to FIG. 9, these areas are the bullet 1/casing 2 connection point, the rim 4, and the area in and around the primer 5). Thus, areas of the compartment 1215 abutting such ends where there are key areas located may have features that provide protection beyond just the lateral separation of the casing separation wall 1213.

As in the embodiment of FIGS. 1-7, a first key area protection portion 1211 is provided along front interior wall 1224*a*. This protection portion 1211 is embodied in the FIGS. 12*a*-12*i* as an aperture providing access to a tip cavity located under that portion of the planar peripheral surface 1223 adjacent the front interior wall 1224*a*. As described above, placing the projectile to extend through aperture 1211 into the tip cavity provides protection for the key area of the connection point between the projectile and the casing and protection from damage for the shape of the projectile.

A second key area protection portion is provided along the rear interior wall 1224*b*. This second key area protection portion is provided to protect the key areas of the ammunition that may be located near the base of the casing 2, for example the rim 4 and the area in and around the primer 5 (see FIG. 9) just as in the embodiment of FIGS. 1-7. This protection portion is hinged (as further explained below) to allow the extra room required when lowering the base end of the ammunition into place. The rear interior wall 1224*b* is then able to be in snug association with the base end of the inserted ammunition, protecting any key areas located thereat. The ammunition may be inserted into the compartment when the rear interior wall 1224*b* is hinged into an open state without the need to deform substantially the tray at a portion thereof adjacent to the base portion of the ammunition when inserted. Further protection to the base end is provided by virtue of the side wall 1221*a* which runs parallel to the rear interior wall 1224*b*, thereby resulting in "double-walled" protection.

The embodiment of FIGS. 12*a*-12*i* thus has a feature different than the embodiment of FIGS. 1-7 that enables both loading but also easier removal of ammunition, especially in situations where the user wears gloves or otherwise does not have the ability to use a fingertip to assist in removal of ammunition that is fitted into a compartment 1215. This feature includes a hinge 1261, formed as a transverse linear strip that runs across the bottom of compartments 1215 adjacent the rear interior wall 1224*b*. This hinge permits the rear interior wall 1224*b* and adjacent side wall 1221*a* with the adjoining linear portion of peripheral surface 1223, forming a rear retaining wall 1260, to swing from a normal, ammunition holding state in which the base portions of the ammunition packaged are held snugly against the rear interior wall 1224*b* (see FIGS. 12*a* and 12*e*), and an opened state in which the base portions of the ammunition packaged are freed from engagement of the rear interior wall 1224*b* and such base portions may be grasped by the user to remove the ammunition (see FIGS. 12*b* and 12*e*). Because of the hinge 1261, the first and second separation walls 1213 on opposed sides of the cradling surface are interrupted at the hinge, adjacent the retaining wall 1260, positioned at the base of a casing, to create a rotatable retaining wall 1260. The retaining wall 1260 includes continuation segments of the pairs of opposed separation walls 1213, and each continuation segment has an overhanging tab, resiliently deformable relative to the opposed separation wall upon retaining wall rotation, to receive and grasp an inserted casing base or, when opened, to allow removal of the inserted casing.

Figure 12H:
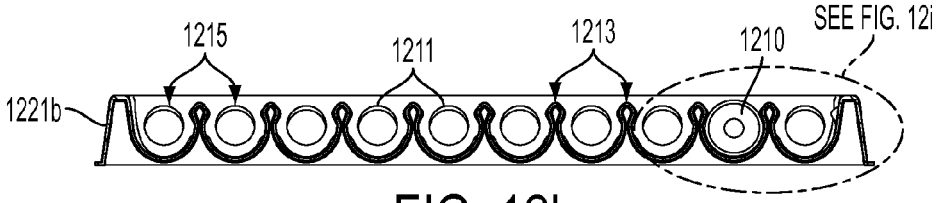
Figure 12I:
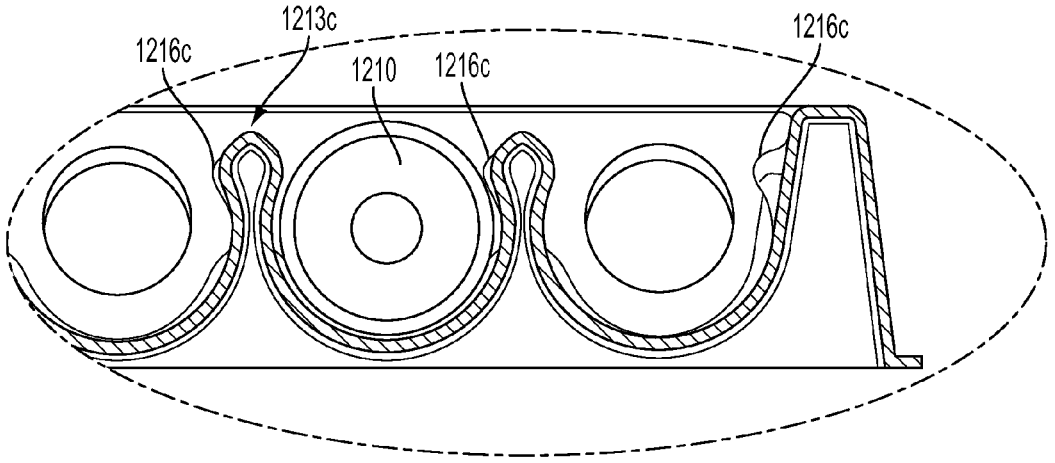

The feature is enabled, first, by the hinge strip 1261 and, second, by a different structure of the rear interior wall 1224*b* where it contacts the base portion of the ammunition. The hinge strip 1261 allows a bend to occur along its length, that allows rotation of retaining wall 1260 to occur, using the bend as the rotational axis. Arrow 1270 in FIG. 12*d* shows the direction of rotational motion. To aid the rear interior wall 1224*b* in its normal, ammunition-holding state, the rear interior wall 1224*b* lacks the inclined portion 114 formed in rear interior wall 124*b* as shown in the embodiment of FIGS. 1-7; instead the rear interior wall is more vertical and, as seen in FIG. 12*h* and the detail of FIG. 12*i*, an extended portion of separation wall 1213 projects from rear interior wall 1224*b* and includes a short securing portion 1213*c*, which includes an extending portion 1216*c* configured as an overhanging tab that extends somewhat over the compartment 1215. This is essentially the same structure as at 1213*b* and it is aligned as a continuation segment of a corresponding separation wall interrupted at the hinge 1261; accordingly, it is contoured to match the contour of the cartridge casing (see FIG. 12*i* and compare to FIG. 6), thus resulting in an area of contact therebetween. Alternatively, the overhanging tab may be contoured to provide only a tangent line of contact. This extending portion 1216*c* includes an undercut geometry that protrudes over the top of the lateral tangent point of the cartridge base portion on one side thereof. The structures 1213*c* engage and hold the base portions of each ammunition unit present, until the user presses downward on the portion of upper peripheral surface 1223 adjacent the rear interior wall 1224*b* hard enough to deform the extending portions 1216*c* of each short securing portion 1213*c* that engages a unit of ammunition. This deformation allows the retaining wall 1260 with its short securing portions 1213*c* to rotate away from the cartridge base portions, freeing-them to be finger-grasped. With that grasp available, the units of ammunition can be removed by a further lifting motion that deforms the other deformable surfaces that engage and hold other parts of the unit. For loading the retaining wall 1260 is simply rotated to its open state for ammunition insertion. After insertion, retaining wall 1260 is rotated back to the normal, ammunition holding state. Towards the end of that rotation, the short securing portions 1213*c* are deformed to grasp the cartridge base portions.

In use, the thermoformed trays 1200 as disclosed herein may be provided in connection with either a box (e.g., cardboard or paper board) or a covering blister (or two enclosing blisters, i.e., a trapping, clamshell configuration) to complete the packaging (i.e., to fully enclose the tray and provide further protection for the ammunition). Where a plastic blister is provided to enclose the tray, sealing means, such as adhesives, hot melt, or RF (radio frequency) sealing may be provided to join a covering blister to a tray 1200 at its periphery or to join two blisters in a clamshell containing a tray 1210, to ensure a secure packaged enclosure. Further, where a covering plastic blister is provided, it may have peripheral side sloping down from a covering surface that mate with opposed lengthwise sides 1221*a* and 1221*b*, and the peripheral flange 1222 may be used to support the blister over the tray in position prior to application of the sealing. Of course, a combination of both a box (or other form of outer carton) and a blister (or two blisters) may be provided to complete the enclosure of the tray/ammunition.

Fourth Embodiment

With reference now to another alternative embodiment of the invention, disclosed in FIGS. 13*a*-13*g* is another thermoformed protective packaging tray 1300 for use in packaging ammunition, in particular, ammunition units comprising elongated cartridges. As with the tray of FIGS. 1-7, the tray may be generally rectangular in shape, having a length, width, and height. As with FIGS. 12*a*-12*i*, this tray 1300, also has a hinged feature, but it is unlike that of FIGS. 12*a*-12*i*, because it has first and second trays to accommodate two rows of cartridges. The two trays are joined at a center hinge structure and have an open and a folded-together mode, as will be explained below.

Figure 13A:
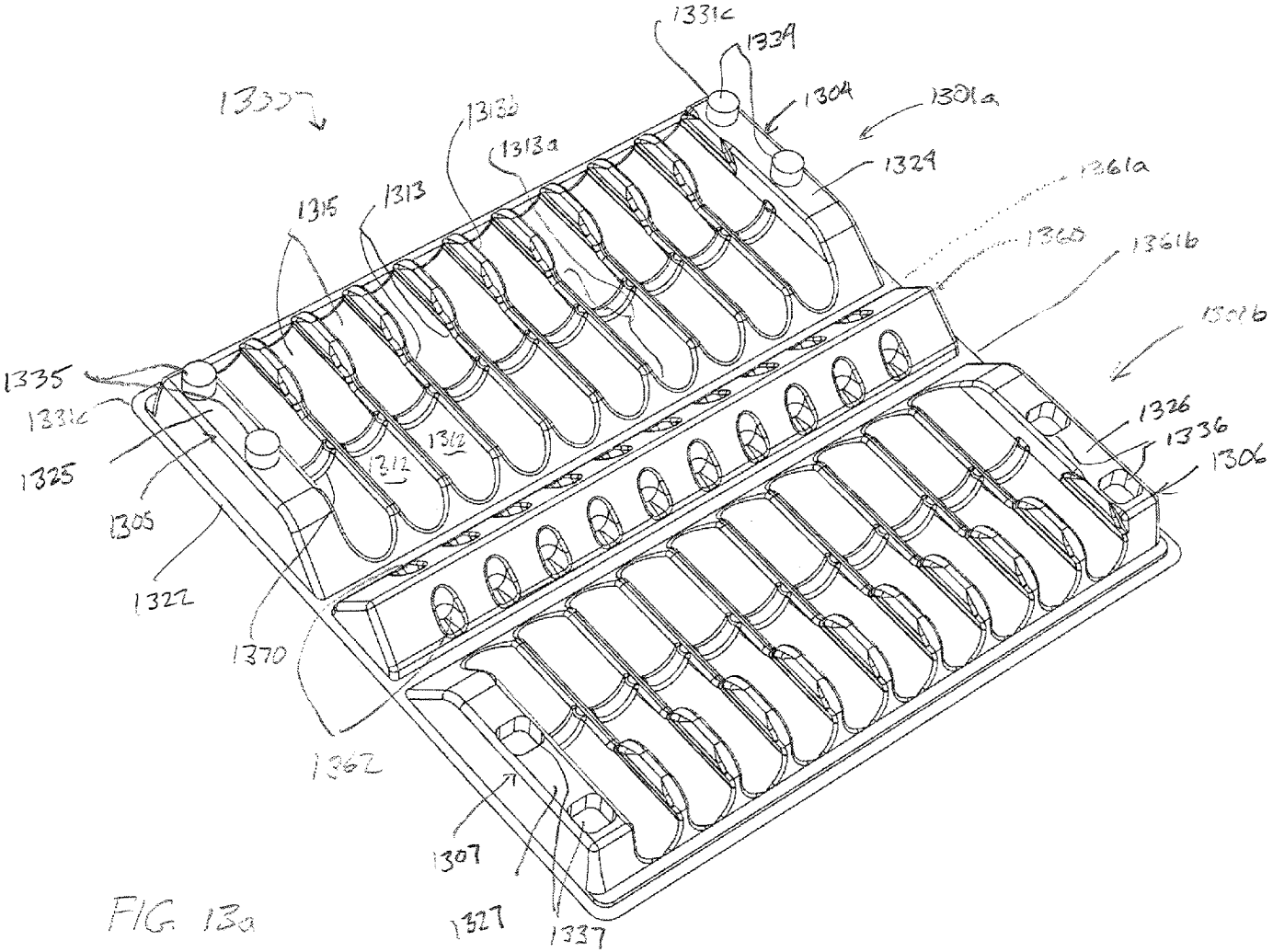
FIGS. 13*a*-*f* are various views of a dual tray alternative embodiment of ammunition packaging in accordance with the present disclosure, including, respectively, a perspective view with the dual trays and center hinge structure laid open and flat (FIG. 13*a*), a top plan view based on FIG. 13*a* (FIG. 13*b*), a lengthwise side perspective view (FIG. 13*c*), an end perspective view with the dual trays and center hinge structure laid open and flat (FIG. 13*d*), a bottom plan view based on FIG. 13*a* (FIG. 13*e*), a perspective view of the dual tray package filled with cartridges, folded up vertically and locked together, with the package resting on the center hinge structure (FIG. 13*f*) and an cross-sectional view of the filled package taken on plane G-G-G of FIG. 13*f* (FIG. 13*g*).
Figure 13B:
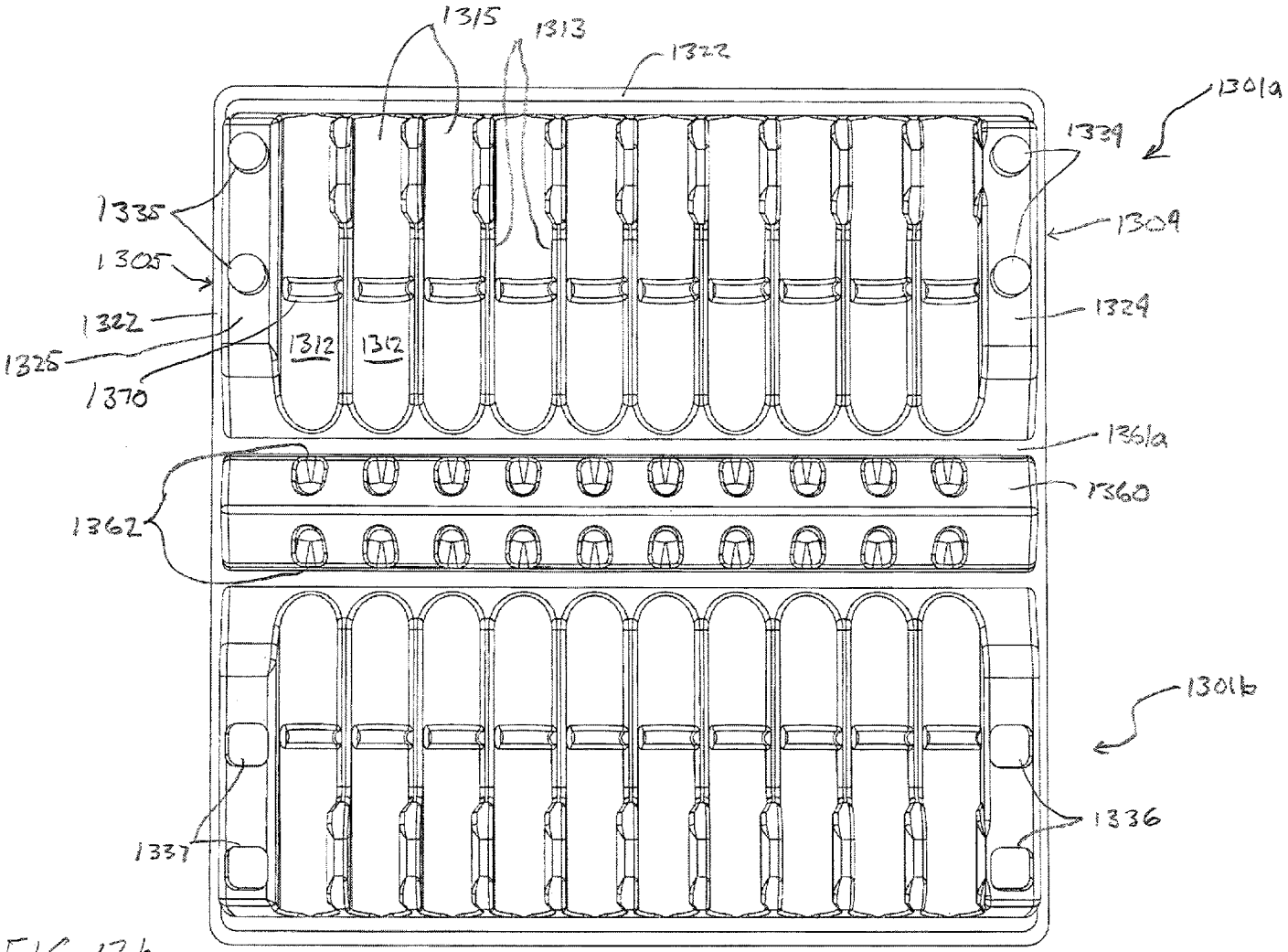

As seen best in the perspective and plan views (FIGS. 13*a* and 13*b*), the packaging tray 1300 may include a pair of symmetrical first and second trays 1301*a* and 1301*b* joined by a center hinge channel 1360 that has a first flexible, longitudinal hinge strip 1361*a* joining the hinge channel 1360 to tray 1301*a* and a second flexible, longitudinal hinge strip 1361*b* joining the hinge channel 1360 to tray 1301*b*. Each of the symmetrical trays 1301*a* and 1301*b* has a pair of opposed ends, 1304, 1305 being the opposed ends of tray 1301*a* and 1306, 1307 being the opposed ends of tray 1301*b*. When the two symmetrical trays 1301*a* and 1301*b* are lying open on a flat surface as seen in FIGS. 13*a* and 13*b*, the generally planar tops of the opposed ends 1304, 1305, 1306, 1307 define an upper end surface 1324, 1325, 1326, 1327 in each of the corners of the opened tray 1300. The upper end surfaces 1324, 1325 together define an upper surface plane 1323*a* for tray 1301*a*, below which ammunition storage compartments 1315 (described in greater detail below are formed). Similarly, the upper end surfaces 1326, 1327 together define an upper surface plane 1323*b* for tray 1301*b*, below which the ammunition storage compartments 1315 of that tray lie. From the upper end surfaces 1324, 1325 protrude pairs of cylindrical lock buttons 1334, 1335, respectively. Upper surfaces 1326, 1327 have pairs of roughly square indentations 1336, 1337 that are intended to snugly and thus, lockingly receive pairs of cylindrical lock buttons 1334, 1335, when the trays 1301*a*, 1301*b* as seen in FIG. 13*a* are folded up symmetrically toward each other (see arrows in FIGS. 13*d*, 13*g*) from the flattened position they have in FIG. 13*a*, such that upper surface planes 1323*a* and 1323*b* (see dotted lines in FIGS. 13*d*, 13*g*) lie adjacent each other.

Because trays 1301*a* and 1301*b* are symmetrical on either side of the center hinge channel 1360, the detailed structure only of tray 1301*a* will be described. This structure is generalizable to tray 1301*b*. Being thermoformed from a sheet, tray 1301*a*, together with tray 1301*b* and center hinge 1360, tray 1301 can be viewed as having each of opposed, parallel ends 1304 and 1305 formed as a downwardly open channel spanning the width of the tray 1301*a*. Between the two ends 1304, 1305 the sheet portion forming tray 1301*a* is formed with a series of parallel ammunition storage compartments 1215, all also oriented parallel to ends 1304 and 1305 and thus having their longitudinal axes oriented perpendicular to the longitudinal hinge strip 1361*a*. As shown in the FIGS. 13*a*, 13*b*, and 12*e*, ten cartridge/ammunition storage compartments 1315 are provided in this example embodiment, enabling ten cartridges to be stored in the packaging tray 1301*a* (with a like number in 1301*b*, having their longitudinal axes oriented perpendicular to the longitudinal hinge strip 1361*b*). However, fewer or a greater number of compartments 1315 may be present. The aligned, opposed ends of the compartments 1315, form a pair of slanted, scalloped, parallel, length-wise outer and inner walls, 1340, 1342 (FIG. 13*d*). Outer wall 1340 rises from the free, outer edge of tray 1301*a* to extend between ends 1304 and 1305, and inner wall 1342 rises from the hinge strip 1361*a*, also to extend between ends 1304 and 1305. The outer length-wise side wall 1340 may be connected to the each of the two ends 1304, 1305 at rounded corners 1331*c*. A peripheral flange 1322 (narrow, as shown, but wider in other embodiments) will typically be connected to the ends 1304, 1305 and the lengthwise outer wall 1340 at the lower edges thereof, as an artifact of the thermoforming process or as a matter of design. (As described above, such flange 1322 together with hinge strip 1360*a* may be used to add strength, particularly to the length-wise walls 1340, 1342 or to provide support for a blister or other enclosure to be provided with the tray, and sealed thereto, to complete the packaging).

Figure 13C:
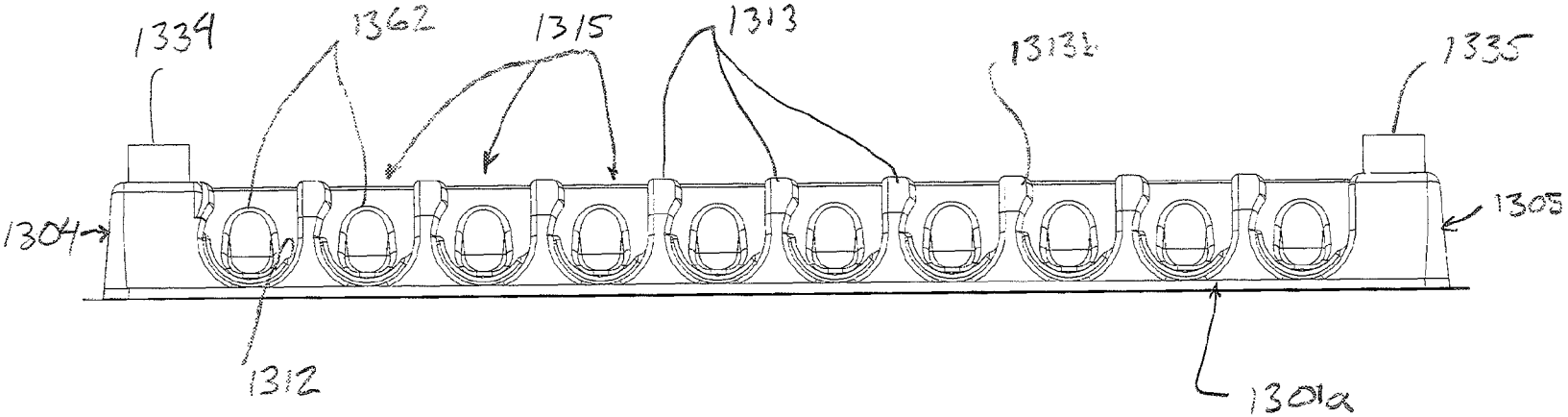
Figure 13D:
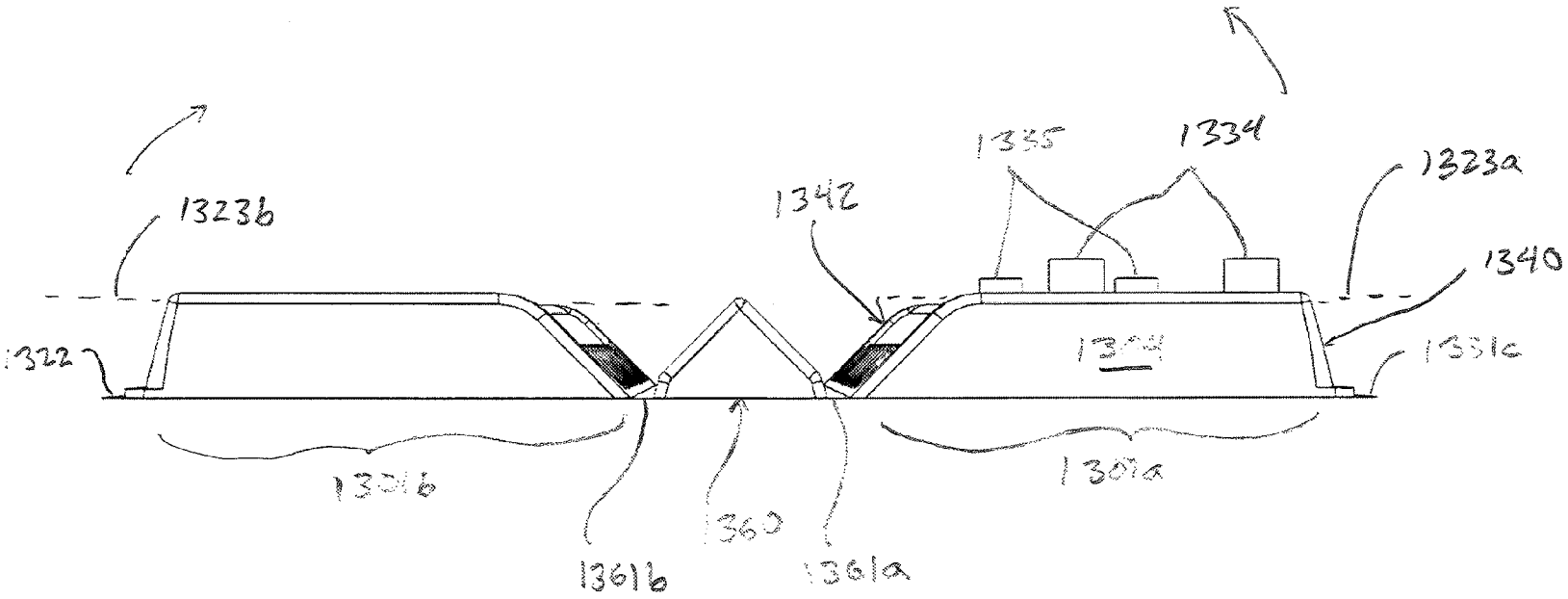
Figure 13E:
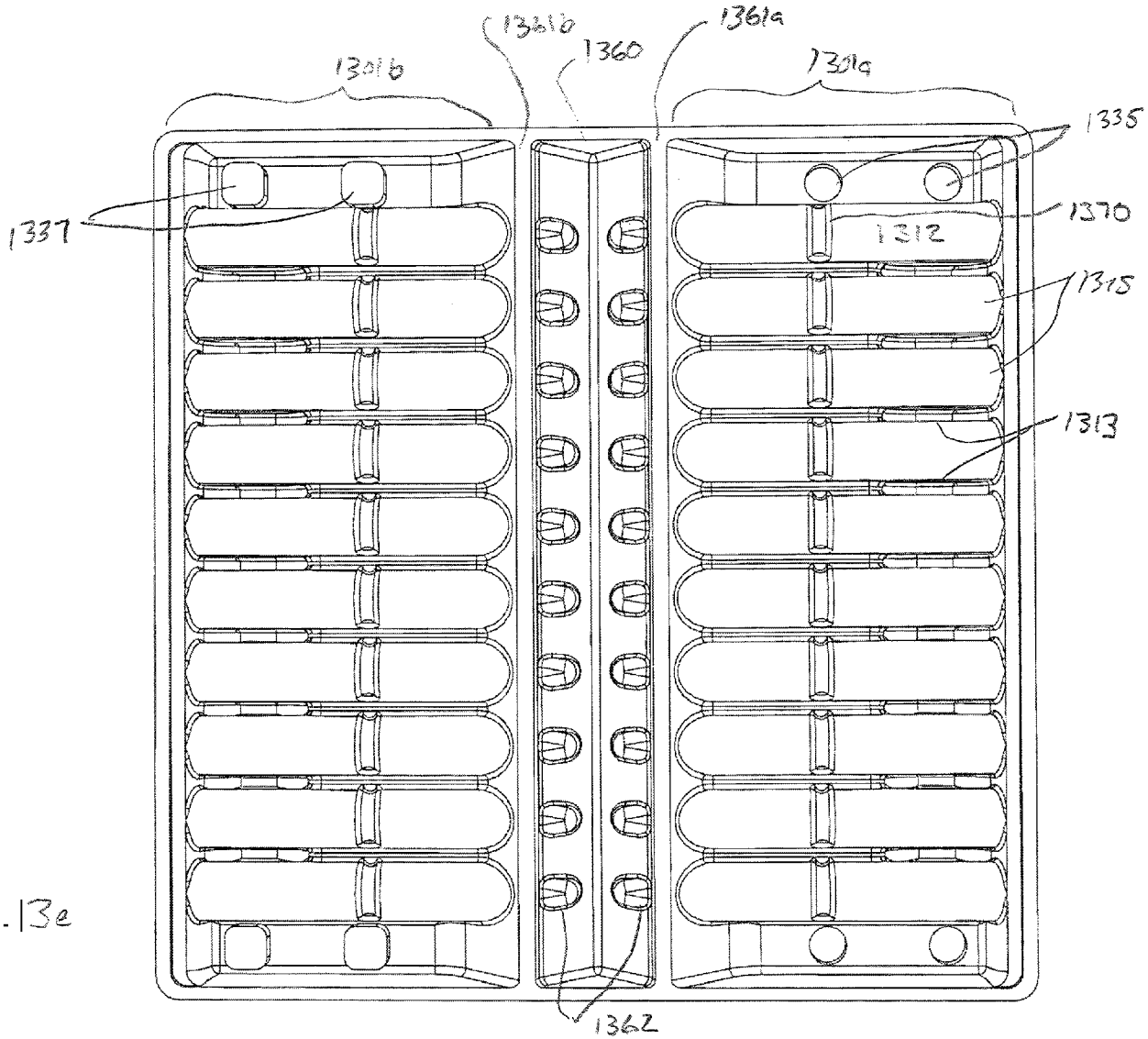

Referring now also to FIGS. 13*c* and 13*d*, the outer end and lengthwise walls forming the peripheral wall surfaces of tray 1301*a* are at an angle that slopes inward from the periphery flange 1322. Thus, rather than making a perpendicular rise, these walls may rise, for example, at an angle generally between about 95 degrees and 120 degrees. This off-perpendicular connection between the upper peripheral surfaces (1323*a* on tray 1301*a*) and the peripheral walls allows for nesting of multiple empty trays, flattened and placed on top of one another, as with the prior embodiments. In some embodiments, however, one or more of the peripheral walls need not be included on the tray 1300.

While a rectangular-shaped tray is shown in the embodiment of FIGS. 13*a*-13*g*, it should be appreciated that the tray 1300 is not limited to rectangular forms, or to rectangular forms with dimensions substantially as shown. Rather, other shapes are presently contemplated, including square, circular, oval, ovoid, triangular, polygonal, and others. Further, a wide range of tray depths (height of the peripheral walls, seen most readily at ends 1304, 1305) is contemplated. In choosing a particular shape and size, it is contemplated that the type and number of cartridges sought to be packaged will determine the dimensions employed. In the example depicted in the FIGS. 13*a*-13*g*, the length of the tray 1300 is determined by the number of cartridges sought to be packaged and such cartridges' width or diameter (as a multiple thereof), the width of the tray is determined by the length of the cartridge, and the height of the tray is determined by the width or diameter of the ammunition. In particular, the ammunition units may be elongated cartridges.

Referring also to FIGS. 13*a* and 13*c* recessed downwardly from the plane of a upper tray surface 1323*a* defined by the plane of upper end surfaces 1324, 1325, and situated inwardly from ends 1304, 1305, are provided the plurality of ammunition storage compartments 1315. As shown in the FIGS. 13*a*, 13*c*, and 13*c*, ten ammunition storage compartments 1315 are provided in this example embodiment, enabling ten cartridges to be stored in each of the packaging trays 1301*a* and 1301*b*. Each ammunition storage compartment 1315 is elongated, extending between the generally opposed pair of lengthwise walls 1340, 1342, and defined on the bottom side thereof by an ammunition supporting or cradling surface 1312, on lateral sides thereof by ammunition separating walls 1313. The elongated configuration is useful for ammunition such as cartridges, which have a generally elongated shape. However, compartments may be shaped so as to accommodate whatever ammunition type is being packaged.

With particular attention to ammunition cradling surfaces 1312, such surfaces may be provided in a shape to substantially match a portion of the shape of the ammunition unit sought to be packaged. In the example embodiment shown in FIGS. 13*a*-13*g*, where, as previously mentioned, the desired ammunition is cartridges, the ammunition cradling surfaces 1313 are curved to substantially match the curvature of the casing. In this manner, the casing is supported in place through direct contact, on its bottom side (i.e., the ammunition is "cradled"), with a curved cradling surface 1312. Each compartment 1315 is provided with such a surface 1312. Other cradling surface 1312 shapes may be required where the ammunition is of different shape, e.g., flat, angled, irregular, etc. The cradling surface may be continuous as shown or have interruptions or apertures (not shown), formed by cutouts in the thermoformed sheet.

With particular attention to ammunition separating walls 1313, such walls may be provided to ensure separation between each ammunition unit so that the ammunition unit does not come in contact with the adjacent unit during shipping and transportation. As shown, the thickness of separating walls 1313 is relatively small, for example, less than about 25% of the width of the compartments 1315. This allows the ammunition to be "dense-packed" within the tray (thus reducing the needed size of the tray and the needed amount of material), while still maintaining adequate separation between the ammunition. The walls 1313 are arranged parallel to one another and are generally straight along their length, in order to accommodate cartridges which are generally continuous and straight along their casing length. However, non-parallel or non-straight walls 1313 may be provided where the shape of the enclosed ammunition so dictates. Separating walls 1313 can be formed as molded bends in the thermoform sheet, resulting in a cavity, negative space or relief therebeneath (as shown in FIG. 13*c*). Alternatively, the package may be formed from two separately-formed thermoformed components. One may be a base thermoformed component, with the overall structure but without certain detail features, which are made in a second, thermoformed insert component that may be fitted into or onto a portion of the base thermoformed component. For example, separating walls 1313 may be formed as a separate transverse strip extending between ends 1304, 1305, and by inserting this additional strip into the base thermoformed component after it has been thermoformed. The strip is configured for a friction fit into or onto the base thermoformed component, such that its features are added at specific locations in the base thermoformed component.

In some embodiments, the walls 1313 may include two or more portions. A first portion 1313*a*, which may be referred to as a separating portion, and a second portion 1313*b*, which may be referred to as a securing portion. Whereas portion 1313*a* generally serves to separate adjacent ammunition units from one another, as described above, securing portion 1313*b* not only serves a separation purpose, but also a securing purpose with respect to the ammunition. As was explained above for the embodiment of FIGS. 1-7 for a comparable structure, securing portion 1313*b* includes an extending portion configured as an overhanging tab that extends somewhat over the compartment 1315, and is contoured to match the contour of the cartridge casing, thus resulting in an area of contact therebetween. Alternatively, the overhanging tab may be contoured to provide only a tangent line of contact. This extending portion includes an undercut geometry that protrudes over the top of the lateral tangent point of the cartridge on one side thereof. On the other side of compartment 1315, opposite the extending portion on the securing portion 1313*b* is a generally vertical wall, which serves to hold the cartridge in place with reference to the extending portion. In embodiments where the walls 1313 are formed by a molded bend in the thermoform sheet, the overhanging tab of the extending portion is formed by broadening the cavity under the bend, relative to the amount of separation between the ascending and descending portions of the sheet leading to the bend.

Thus, the supporting or cradling surface 1312 and the securing portion 1313*b*, are essentially the same as in the embodiment of FIGS. 1-7. However, a lug 1370 is added to the cartridge cradle 1315 that is meant to retard the motion of cartridges (in particular downward motion, when the trays 1301*a*, 1301*b* are folded and locked together and cartridges tips point downward, as further described below), to minimize the ability of the bullet tip to contact the bottom of the package during rough handling. With the various cradling features, the secured cartridge will not be free to move easily in any direction normal to its longitudinal axis when positioned within the compartment 1315, and, in order to more easily insert or remove the ammunition, the extending portion on the securing portion 1313*b* may be resiliently deformable. The lug 1370 in the cartridge compartment is meant to retard the motion of cartridges downward, to minimize the ability of the bullet tip to move. The cartridges used with this packaging are significantly heavier—and the lug 1370 bears on the shoulder of the cartridge to limit motion. This concept is designed to handle larger cartridges (e.g., approximately 0.308 in/7.62 mm caliber as opposed to the original 0.223 in/5.56 mm caliber)

In the bi-fold clamshell with an open top as shown in FIGS. 13*a*-13G, the tips are now protected by the "bottom" hinge channel panel of the thermoformed sheet. The rim 4 and the area in and around the primer 5 of the cartridge sits slightly below the top edge of the clamshell formed by the two trays 1301*a*, 1301*b* when folded (the outer portions of the tray flanges 1322 will contact the inside of an enclosing box before the cartridge does), and the two trays fold together and join positively, by a plurality of buttons located on one of the first and second trays being matingly inserted into a corresponding plurality of indentations on the other of the first and second trays, to hold the first and second trays with their upper tray surfaces adjacent each other. The package can be loaded while the trays are spread open or when joined, and cartridges can be accessed with the tray open or joined. This allows more protection to the cartridges within an outer carton, allows reduced tooling costs less by eliminating the need for match-metal tooling, and enhances consumer experience by allowing them two different means of dispensing.

As with the prior embodiments shown, the securing portion 1313*b* occupies about ¼ or ⅓ of the total length of the wall 1313, and is positioned at one end thereof, with a separating portion 1313*a* forming the balance of wall 1313. The length of the securing portion(s) 1313*b* may be selected in combination with the thickness of the sheet stock to balance the resilient force resisting insertion when the package is loaded and then holding the ammunition in the compartment against the desire that such force not impair easy deflection of the securing portion 1313*b* when cartridge removal is desired.

Figure 13F:
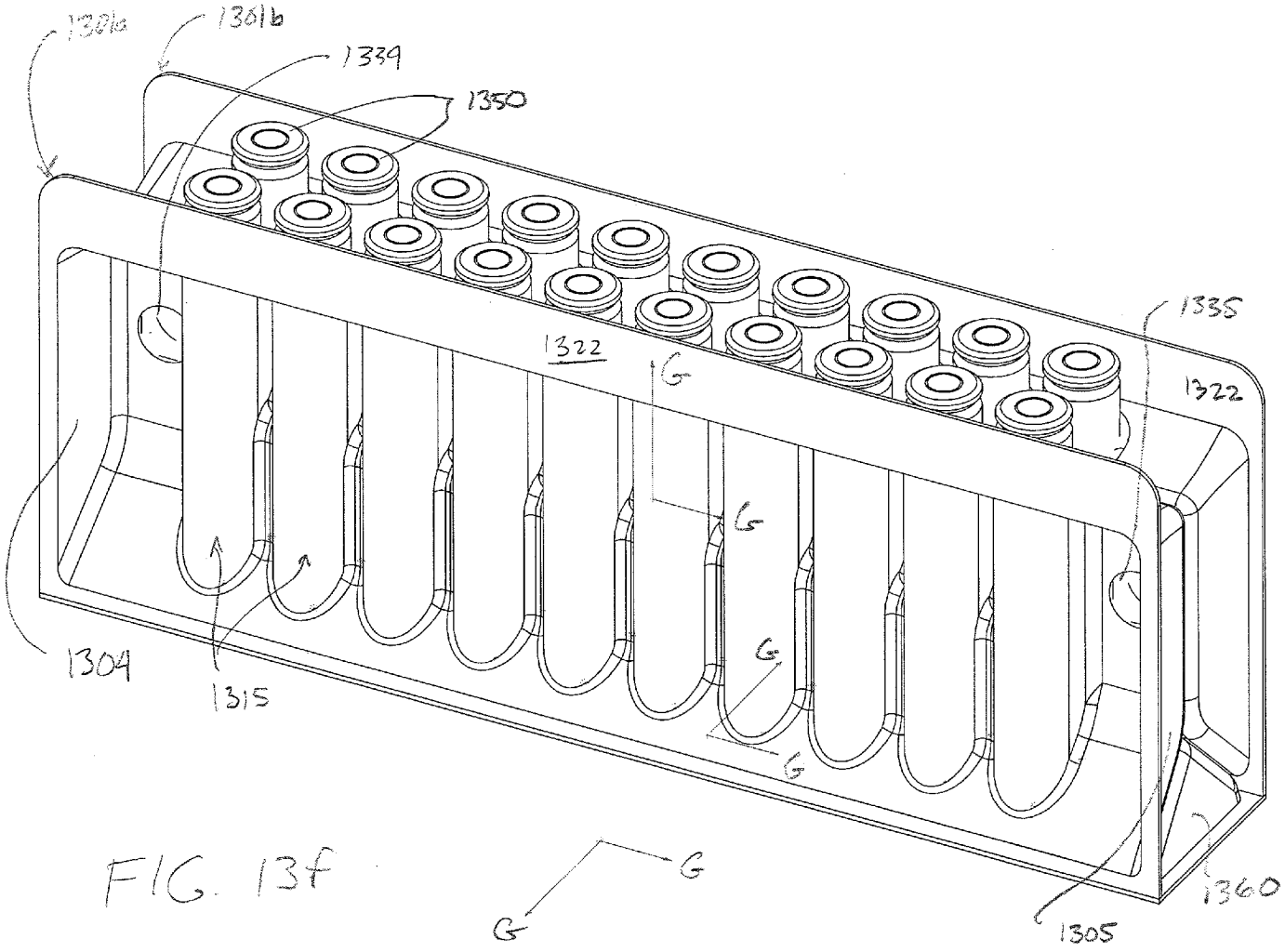
Figure 13G:
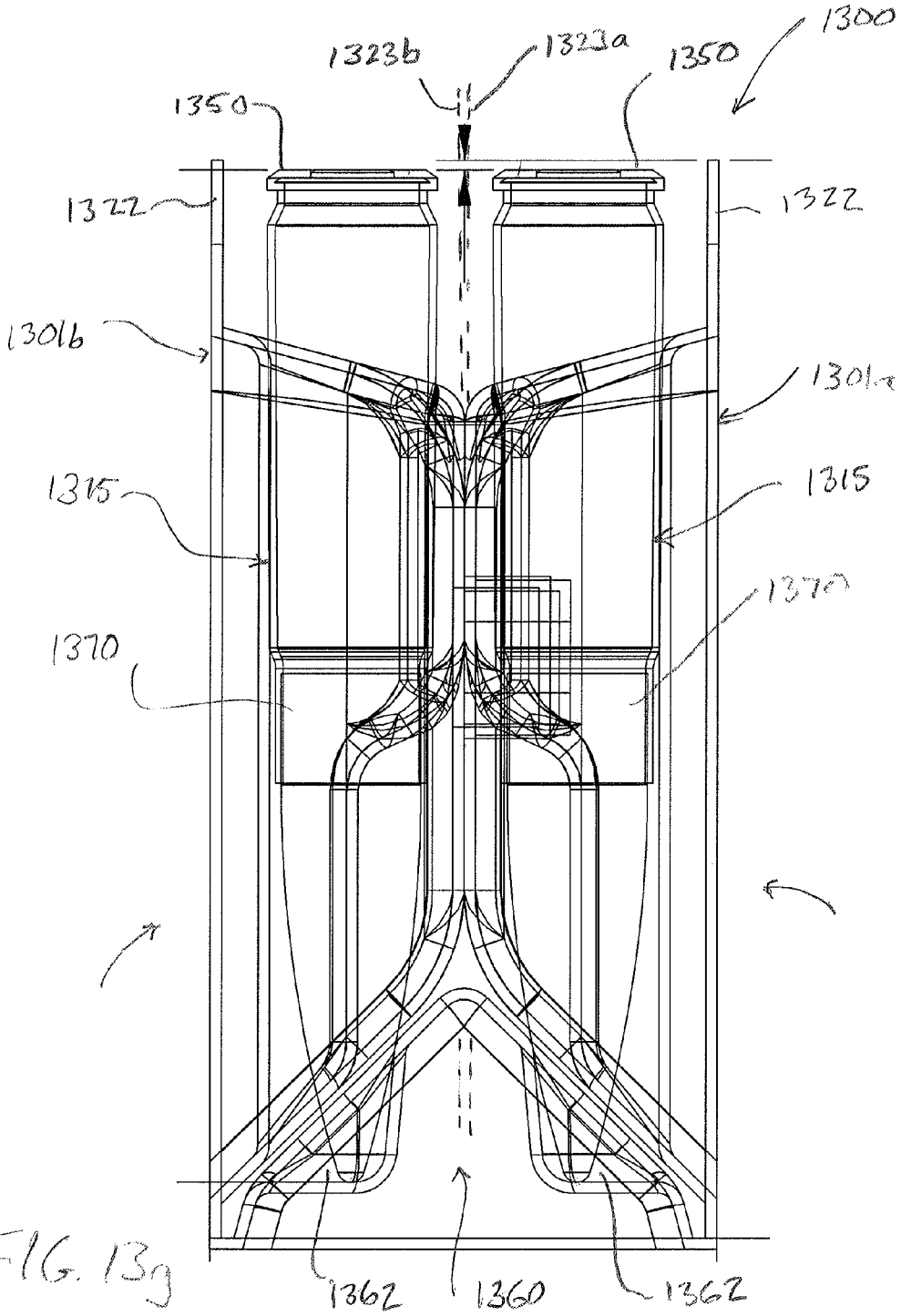

FIGS. 13*f* and 13*g* show how the two trays 1301*a*, 1301*b* can be folded up vertically and joined and locked together after being loaded with cartridges 1350. (The trays in FIGS. 13*g* and 13*f* reflect a slight variant relative to those in FIGS. 13*a*-13*e*, because they have on a single button 1334, 1335 or indention 1336, 1337 at each end 1304, 1305, 1306, 1307, rather than a button or indentation pair.) Each of trays 1301*a*, 1301*b* is rotated from a horizontal, flat position as seen in FIG. 13*a* into a vertical position, as seen in FIGS. 13*f*, 13*g*. When both trays 1301*a*, 1301*b* are vertical, and their upper peripheral surfaces adjacent one another, the buttons 1334, 1335 of tray 1301*a* may be inserted into corresponding, mating indentations 1336, 1337 of tray 1301*b*. Hinge channel 1360 remains horizontal. When trays 1301*a*, 1301*b* are loaded with cartridges 1350, as the trays 1301*a*, 1301*b* are rotated to a vertical orientation, the cartridge tips enter the tip cavity recesses, 1362 that are at intervals along the outer sides of hinge channel 1360. Thus, the hinge channel 1360 works with trays 1301*a*, 1301*b* to form a bi-fold clamshell with an open top.

As discussed above for FIGS. 1-7 and FIGS. 12*a*-12*f*, certain key areas of the ammunition may benefit from additional protection to ensure that they will be free from damage. Some of these areas may be located at or between the ends of the ammunition (e.g., the projectile/casing connection point, the loading means, and the ignition means—with reference to FIG. 9, these areas are the bullet 1/casing 2 connection point, the rim 4, and the area in and around the primer 5). Thus, areas of the compartment 1315 abutting such key areas located may have features that provide protection beyond just the lateral separation of the casing separation wall 1313.

A first key area protection portion 1362 is provided along the angled sides of center hinge 1360. This protection portion 1362 is embodied in the FIGS. 13*a*-12*g* as a recess forming a tip cavity. As seen in FIG. 13*g*, placing the projectile to extend through into the tip cavity 1362 provides protection from damage for the shape of the projectile.

A second key area protection portion is provided along the cartridge body. This second key area protection portion includes lug 1370, which is place and shaped to make with the area just below bullet 1/casing 2 connection point. A third key area of the ammunition for protection may be located near the base of the casing 2, for example the rim 4 and the area in and around the primer 5 (see FIG. 9) just as in the embodiment of FIGS. 1-7. In the folded tray configuration of FIGS. 13*f*, 13*g*, protection is provided by the extension of the flange 1322 of each of trays 1301*a*, 1301 just beyond the base of the casing 2 and the rim 4. The ammunition thus rests in the individual cradles 1315 and when the folded and joined trays are locked together and place in a carton, there is protection for key areas of each cartridge 1350.

The embodiment of FIGS. 13*a*-13*f* thus has a feature different than the other embodiments that enables easier removal of ammunition. Specifically, the base portions of the ammunition packaged are free and such base portions may be grasped by the user to remove the ammunition by pulling it an upward direction as seen in FIGS. 13 and 13*g* Because of this mode of withdrawal, the overhanging tab, resiliently deformable relative to the opposed separation wall requires little or no deformation, to allow removal of the inserted cartridge on a path aligned with the cartridge axis.

In use, the thermoformed trays 1300, formed as two trays with a hinge to form a bi-fold clamshell as disclosed herein may be provided in connection with a box (e.g., cardboard or paper board) to complete the packaging (i.e., to fully enclose the tray and provide further protection for the ammunition).

As can be seen, a variety of packages for holding a plurality of ammunition units, with each unit having an axially elongated casing with a base and a projectile joined to the casing opposite its base can be made from a thermoformed sheet, formed to have a plurality of elongated compartments for receiving an ammunition unit. In these packages each compartment is recessed from a planar peripheral upper surface and has a cradling surface extending along an axis of an inserted ammunition unit for supporting its casing and first and second separation walls on opposed sides of the cradling surface. At least one of the first and second separation walls comprises an overhanging tab, resiliently deformable relative to the other opposed separation wall to receive and grasp the casing upon insertion or to allow removal of the casing.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular embodiments. Functionality may be separated or combined in procedures differently in various embodiments of the disclosure or described with different terminology. These and other variations, modifications, additions, and improvements may fall within the scope of the disclosure as defined in the claims that follow.

What is claimed is:

1. A package for holding a plurality of ammunition units, each having a casing with a base and a projectile joined to the casing opposite its base, comprising:

a thermoformed sheet, comprising a tray having a plurality of compartments for receiving ammunition units, each compartment recessed from a planar, upper tray surface and comprising:

a supporting surface extending along an inserted ammunition unit for supporting its casing;

first and second separation walls on opposed sides of the supporting surface, wherein one of the separation walls comprises an overhanging tab opposite a generally flat surface of the other, opposed separation wall, said tab being resiliently deformable to receive and grasp the casing upon compartment insertion or to allow removal of the casing; and at least one protection portion for protecting a key area of the ammunition from impact.

2. The package of claim 1, wherein a molded bend extending portion of the thermoformed sheet resulting in a cavity, negative space or relief therebeneath forms the overhanging tab.

3. The package of claim 1, wherein the thermoformed sheet is made from a material selected from the group consisting of PET, PVC, HIPS, HDPE and bioplastics.

4. The package of claim 1, wherein the thermoformed sheet has a thickness between about 0.005 to 0.080 inches.

5. The package of claim 1, wherein the thermoformed sheet is formed as first and second trays that are joined to a center hinge with each of the first and second trays comprising a plurality of compartments for receiving an ammunition unit and oriented with longitudinal axes of the plurality of compartments oriented perpendicular to a hinge strip that joins the hinge strip to the center hinge, said hinge strips allowing the first and second trays to be rotated to lie with their upper tray surfaces adjacent each other.

6. The package of claim 5, wherein the center hinge is a hinge channel with the hinge strips lying along the parallel outer edges of the channel, said center hinge including a plurality of recesses each aligned with an adjacent of one of the plurality of compartments for receiving an ammunition unit, whereby when the first and second trays are filled with cartridges and rotated to lie with upper tray surfaces of the first and second trays lying adjacent each other, each cartridges tip is received in one of the recesses aligned with an adjacent end of one of the plurality of compartments.

7. The package of claim 5, wherein ends, when the first and second trays are rotated to lie with their upper tray surfaces adjacent each other, a plurality of buttons located on one of the first and second trays may be matingly inserted into a corresponding plurality of indentations on the other of the first and second trays, to hold the first and second trays with upper tray surfaces of the first and second trays lying adjacent each other.

8. The package of claim 7, wherein each of the first tray and second tray has a pair of opposed ends and each of the pair of opposed ends of one of the first tray and second has either a pair of buttons or a pair of indentations for mating interlock with a corresponding pair of buttons or indentations on the other of the first tray and second tray.

9. The package of claim 1, wherein the overhanging tab extends about one fourth or one-third the length of the separation wall that comprises the overhanging tab.

10. The package of claim 1, wherein a molded bend extending portion of the thermoformed sheet forms the overhanging tab and lies opposite a generally vertical surface of the other, opposed separation wall.

11. The package of claim 1, wherein a molded bend extending portion of the thermoformed sheet forms the overhanging tab and is contoured to match the contour of the casing.

12. The package of claim 1, wherein for each of the plurality of compartments, the one of the first and second separation walls that comprises the overhanging tab is oriented on the same side of each compartment as seen in a cross-section of the plurality of compartments, such that an air-eject driving the thermoformed sheet off of, or out of, a mold moves all overhanging tabs sideways in one direction.

* * * * *